US009745676B2

(12) United States Patent
Hatanaka et al.

(10) Patent No.: US 9,745,676 B2
(45) Date of Patent: Aug. 29, 2017

(54) WOVEN MATERIALS HAVING TAPERED PORTIONS

(71) Applicant: Apple Inc., Cupertino, CA (US)

(72) Inventors: Motohide Hatanaka, Tokyo-to (JP); Ying-Liang Su, Shenzhen (CN); Yoji Hamada, Tokyo-to (JP)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/062,027

(22) Filed: Mar. 4, 2016

(65) Prior Publication Data

US 2016/0258085 A1 Sep. 8, 2016

Related U.S. Application Data

(60) Provisional application No. 62/129,632, filed on Mar. 6, 2015.

(51) Int. Cl.

| | |
|---|---|
| ***D03D 1/00*** | (2006.01) |
| ***D03D 13/00*** | (2006.01) |
| ***D03D 11/00*** | (2006.01) |
| ***D03D 3/06*** | (2006.01) |
| ***D03D 15/08*** | (2006.01) |

(52) U.S. Cl.

CPC ..... *D03D 11/00* (2013.01); *D03D 3/06* (2013.01); *D03D 13/004* (2013.01); *D03D 15/08* (2013.01)

(58) Field of Classification Search

CPC ..... G06F 1/163; A44C 5/0053; D03D 1/0094; D03D 2700/02; D03D 3/00; D03D 13/004; D03D 13/008

See application file for complete search history.

(56) References Cited

U.S. PATENT DOCUMENTS 1,799,868 A * 4/1931 Sauer, Jr. ..... A44C 5/0053 2/338
2,514,818 A * 7/1950 White ..... A44B 11/22 24/176

(Continued)

FOREIGN PATENT DOCUMENTS

| | | |
|---|---|---|
| BE | 555150 | 2/1957 |
| CH | 335252 | 2/1959 |

(Continued)

*Primary Examiner* — Bobby Muromoto, Jr.
(74) *Attorney, Agent, or Firm* — McDermott Will & Emery LLP

(57) ABSTRACT

Woven material having tapered portions and altering the weave pattern and/or material construction in the tapered portion. The woven material includes a first width portion comprising a first weave pattern formed in a plurality of layers of warp threads. The plurality of layers of warp threads include two distinct outer columns of warp threads, and inner columns of warp threads positioned between the two distinct outer columns. The woven material may also include a tapered width portion formed adjacent the uniform portion. The tapered portion includes the first weave pattern formed in the plurality of layers of warp threads of the inner columns of warp threads, and a second weave pattern formed in at least a portion of the plurality of layers of warp threads of the two distinct outer columns of warp threads. The second weave pattern may be distinct from the first weave pattern.

13 Claims, 26 Drawing Sheets

(56) References Cited

U.S. PATENT DOCUMENTS 2,521,375 A * 9/1950 Johnston ..... A44C 5/145 224/168
2,581,261 A * 1/1952 Landau ..... D03D 1/0094 139/383 R
2,696,839 A 12/1954 Schuerhoff
2,891,306 A * 6/1959 Fontana ..... B21F 43/00 29/414
3,362,595 A 1/1968 Herzog
3,690,064 A * 9/1972 Pompeo ..... A44C 5/02 59/35.1
3,702,670 A * 11/1972 Luft ..... A44C 5/0061 224/173
3,885,383 A 5/1975 Tanaka
4,089,161 A * 5/1978 Aoki ..... A44C 5/107 59/80
4,266,400 A * 5/1981 Tabata ..... A44C 5/025 224/179
4,576,154 A * 3/1986 Hyman ..... A61F 13/148 128/100.1
4,585,037 A 4/1986 Kimbara
4,660,605 A * 4/1987 Koch ..... B60R 22/12 139/117
4,662,407 A 5/1987 Duncan
4,748,078 A 5/1988 Doi et al.
4,846,230 A * 7/1989 Mock ..... A41F 9/002 139/383 R
5,089,669 A 2/1992 Piper et al.
5,219,636 A 6/1993 Golz
5,437,314 A 8/1995 Sainen
5,438,851 A 8/1995 Geissbuhler
5,465,762 A 11/1995 Farley
5,529,826 A 6/1996 Tailor et al.
6,336,475 B2 1/2002 Dewispelaere et al.
6,376,047 B1 4/2002 Hasegawa
7,143,437 B2 11/2006 Royer et al.
7,275,667 B2 10/2007 Bertucci
7,836,917 B1 11/2010 Osborne
7,909,066 B2 3/2011 Wada
8,039,083 B2 10/2011 Higashinaka et al.
8,603,374 B2 12/2013 Domagalski et al.
8,651,150 B2 2/2014 Siebert
9,367,094 B2 * 6/2016 Bibl ..... G06F 3/0412
2006/0166577 A1 7/2006 Rashed
2013/0008554 A1 1/2013 Fisher et al.
2014/0135906 A1 5/2014 Winner et al.
2015/0174854 A1 * 6/2015 Siahaan ..... B32B 5/024 428/212
2016/0037866 A1 2/2016 Rohrbach et al.

FOREIGN PATENT DOCUMENTS

| | | |
|---|---|---|
| CN | 201546014 | 8/2010 |
| CN | 203382963 | 1/2014 |
| CN | 203513965 | 4/2014 |
| EP | 0036527 | 3/1981 |
| FR | 1217530 | 5/1960 |
| JP | 2006130167 | 5/2006 |
| JP | 2012172281 | 9/2012 |
| WO | WO2009059209 | 5/2009 |

* cited by examiner

WOVEN MATERIALS HAVING TAPERED PORTIONS

CROSS-REFERENCE TO RELATED APPLICATION

This application is a nonprovisional patent application of and claims the benefit of U.S. Provisional Patent Application No. 62/129,632, filed Mar. 6, 2015 and titled "Woven Materials Having Tapered Portions," the disclosure of which is hereby incorporated herein by reference in its entirety.

TECHNICAL FIELD

The disclosure relates generally to woven materials, and more particularly to the woven materials having tapering portions and altering the weave pattern and/or material construction in tapered portions of the woven materials to improve physical characteristics and/or visual and/or tactile features.

BACKGROUND

Conventional woven material or fabric is used in a many applications and industries. For example, woven material is used in clothing and other apparel (e.g., shirts, pants, skirts, etc.), in fashion accessories (e.g., bracelets, watch bands, necklaces, etc.), in electronics (e.g., woven conductive layers, protective sheaths for optical fiber cables and the like), and other various industrial applications (e.g., rope, tape, protective gear, household/kitchenware, etc.). Due to the many uses and applications, conventional woven material is manufactured using specific material and/or manufactured to include specific physical properties. For example, where the woven material is used to form a bracelet or necklace, it may be useful for the woven flexibility, durability, and particular dimensions, structures, and physical features all may be incorporated into different woven materials.

As one example, in order to form unique designs or cosmetic embellishments, threads (e.g., warp, weft) of the woven material are often altered or adjusted. For example, in order to form a portion of a woven material that includes a varied dimension, a tapered portion must be formed. The tapered portion may be formed by decreasing the distance between warp threads in the woven material, while continuing to weave the weft material through the warp threads.

However, by decreasing the distance between the warp threads of the woven material, physical characteristics and/or visual and/or tactile features may be effected or changed. For example, when the distance between the warp threads is decreased to form the tapered portion, the overall thickness or width of the woven material may increase in the tapered portion. In another example, the "ribs," or bumps on the edges of the woven material, may increase in size in the tapered portion due to the altered weave pattern. The increase in the size of the ribs of the woven material may undesirably change the visual and/or tactile features of the woven material at the tapered portion.

SUMMARY

Generally, embodiments discussed herein are related woven materials having tapering portions and altering the weave pattern and/or material construction in tapered portions of the woven materials to improve physical characteristics and/or visual and/or tactile features. The weave pattern of a woven material may be altered to modify the size and/or configuration of the ribs formed on the edge and/or in the tapered portion of the woven material. Specifically, the woven material may include an altered weave pattern in its tapered width portion to reduce the size and/or flatten the ribs formed in the edge of the woven material. This may ultimately make the thickness and/or side profile of the tapered portion uniform with the remaining portion of the woven material. The altering of the weave pattern may be achieved by altering the weave pattern in a portion or all of the layers of the multi-layer woven material. Furthermore, the altering of the weave pattern may only take place in portions of the tapered portion positioned adjacent the edge of the woven material. Additionally, the altering of the weave pattern may be achieved by altering a tension placed on elastic fibers forming a portion or all of the weft threads in at least some of the layers of the multi-layer woven material. The tension on the elastic fibers in the tapered width portion may be greater than the tension on the elastic fibers in the remaining portions of the woven material.

One embodiment may take the form of a woven material. The woven material may comprise a first width portion comprising a first weave pattern formed in a plurality of layers of warp threads. The plurality of layers of warp threads may comprise two distinct outer columns of warp threads, and inner columns of warp threads positioned between the two distinct outer columns of warp threads. The woven material may also comprise a tapered width portion formed adjacent the uniform portion. The tapered portion may comprise the first weave pattern formed in the plurality of layers of warp threads of the inner columns of warp threads, and a second weave pattern formed in at least a portion of the plurality of layers of warp threads of the two distinct outer columns of warp threads. The second weave pattern may be distinct from the first weave pattern.

A further embodiment may take the form of a woven material. The woven material may comprise a first width portion formed from a plurality of distinct layers of warp threads, and a tapered width portion formed adjacent the first width portion from the plurality of distinct layers of warp threads. At least a portion of the warp threads in at least one of the plurality of distinct layers may be formed from a plurality of elastic fibers. The plurality of elastic fibers formed in at least the portion of the warp threads in at least one layer of the plurality of distinct layers may be under a first tension in the first width portion, and under a second tension in the tapered width portion. The second tension may be greater than the first tension.

Another embodiment may take the form of a method of forming a woven material. The method may comprise weaving the woven material using a first weave pattern in a first width portion. The woven material may comprise a plurality of distinct layers of warp threads, at least one weft thread woven through the warp threads for each of the plurality of distinct layers, and a plurality of ribs formed on each edge of the woven material by the woven warps threads and the at least one weft thread. The method may also comprise altering a weave pattern of the woven material in a tapered width portion to a second weave pattern, distinct from the first weave pattern. The tapered width portion may be positioned adjacent the first width portion. The method may further comprise modifying at least one of a size and a configuration of the plurality of ribs formed in the tapered width portion of the woven material.

BRIEF DESCRIPTION OF THE DRAWINGS

The disclosure will be readily understood by the following detailed description in conjunction with the accompanying drawings, wherein like reference numerals designate like structural elements, and in which.

Figure 1:
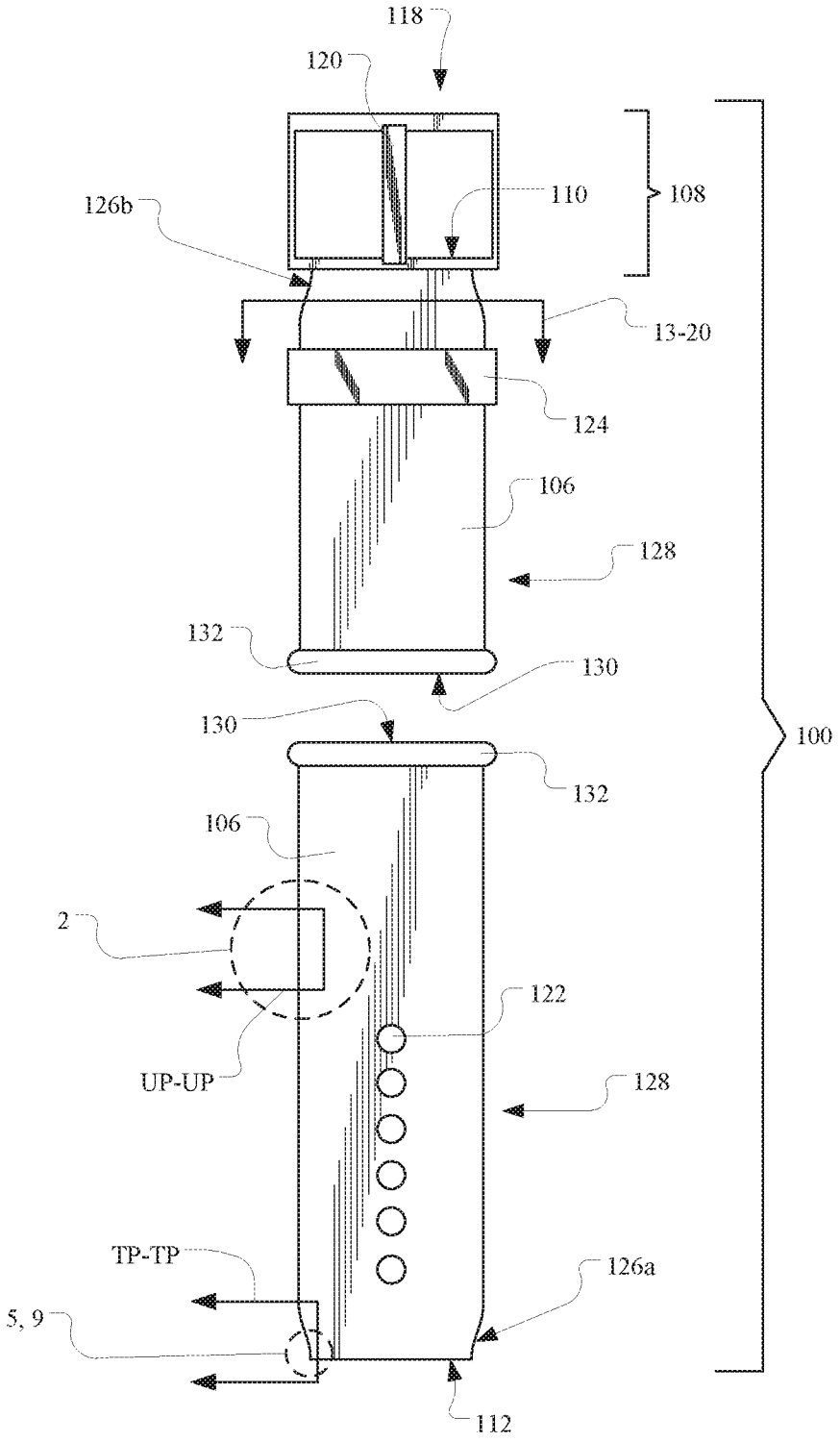
FIG. 1 depicts an illustrative top view of a wearable band formed from a woven material, according to embodiments.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates generally to woven materials, and more particularly to a woven material having tapering portions. Tapered portions or regions may be formed by altering a weave pattern and/or material construction in a particular part of the woven materials. Tapering regions of a woven material may improve physical characteristics, visual features, and/or tactile features. For example, a woven material section maybe tapered uniformly along opposing edges without increasing its thickness.

The weave pattern of a woven material may be altered to modify the size and/or configuration of ribs formed on an edge and/or in a tapered portion of the woven material. For example, the woven material may include an altered weave pattern in its tapered width portion to reduce a dimension (while holding another dimension constant) and/or flatten any ribs formed in the edge of the woven material. This may ultimately make the thickness and/or side profile of the tapered portion uniform with the remaining portion of the woven material.

The tapered region may be achieved by changing the weave pattern in a some or all of the layers of a multi-layer woven material. Furthermore, the altering of the weave pattern may only take place in parts of the tapered portion positioned adjacent the edge of the woven material. As yet another option, the tapered region may be formed by altering a tension placed on elastic weft threads in at least some of the layers of the multi-layer woven material. In a finished product, the tension on the elastic fibers of the weft threads may be greater in the tapered region than in the remaining portions of the woven material.

These and other embodiments are discussed below with reference to FIGS. 1-20. However, those skilled in the art will readily appreciate that the detailed description given herein with respect to these Figures is for explanatory purposes only and should not be construed as limiting.

FIG. 1 shows an illustrative front view of wearable band 100 including woven material 106, according to embodiments. In non-limiting examples, wearable band 100 may be a decorative band (e.g., wristband, armband, headband, necklace, etc.), a watch band, and a wearable band for holding or attaching to a housing of an electronic device including, but not limited to: a smartphone, a gaming device, a display, a digital music player, a wearable computing device or display, a health monitoring device or other suitable electronic device. In a non-limiting example shown in FIG. 1, wearable band 100 may form a watch band that may be coupled to a housing of the wearable electronic device (e.g., watch).

Wearable band 100 may include connection device 108 positioned at a first end 110 of wearable band 100. Connection device 108 may be formed within wearable band 100 to couple ends 110, 112 and/or secure wearable band 100 to a user. Connection device 108 may be any suitable coupling mechanism or embodiment capable of releasably coupling ends 110, 112 of wearable band 100. In a non-limiting example, as shown in FIG. 1, connection device 108 may include a buckle 118. First end 110 of wearable band 100 may include buckle 118 having a tongue 120 coupled to buckle 118. Buckle 118 may receive a portion of second end 112 of wearable band 100, and tongue 120 may be positioned within one of a plurality of holes 122 formed adjacent second end 112 to secure wearable band 100 to a user. The plurality of holes 122 formed through wearable band 100 may be formed using any suitable process including, but not limited to laser cutting, shearing or punching. Additionally, and as discussed herein, connection device 108 (e.g., buckle 118, tongue 120) may be coupled to woven material 106 forming wearable band 100 using a pin (not shown) positioned through a portion of woven material 106.

Second end 112 may be further secured to wearable band 100 using retention loop 124. Retention loop 120 is positioned substantially around wearable band 100 and may be affixed thereto. Retention loop 124 may form an opening to receive second end 112 and/or position second end 112 against a portion of wearable band 100.

As shown in FIG. 1, woven material 106 may also have tapered width portions 126*a*, 126*b*. Tapered width portions 126*a*, 126*b* may be positioned on opposite ends 110, 112 of wearable band 100 and may be separated by uniform width portions 128 of wearable band 100. In the non-limiting example shown in FIG. 1, uniform width portions 128 include a uniform width in wearable band 100 and tapered width portion 126*a*, 126*b* may include a varying, converging and/or narrowing width in wearable band 100 that may be smaller than uniform width portion 128. As discussed herein, woven material 106 may form tapered portion 126*a*, 126*b* in wearable band 100. Tapered portion 126*a*, 126*b* may be formed within wearable band 100 based on, at least in part, the function and/or intended use of wearable band 100. In a non-limiting example where wearable band 100 includes a watch band, tapered portion 126*a* having a smaller width than uniform width portion 128 and the opening formed in retention loop 124, may be formed in wearable band 100 to aid the user in inserting end 112 into retention loop 124 for coupling and/or positioning end 112 on the remaining portion of wearable band 100. In another non-limiting example where wearable band 100 includes a watch band, tapered portion 126*b* may be formed at end 110 in wearable band 100 to aid and/or to ensure that connection device 108 is coupled to the entire portion of woven material 106 at end 110.

Although shown at ends 110, 112 of wearable band 100, it is understood that tapered portion 126 may be formed in distinct portions of wearable band 100. In a non-limiting example, tapered portions 126 may be formed at inner tips 130 of wearable band 100. A coupling mechanism 132 may be coupled to inner tips 130, and similar to end 110 and connection device 108, tapered width portion 126 formed on inner tips 130 may aid in the coupling or securing of coupling mechanism 132 to woven material 106. In the non-limiting example, coupling mechanism 132 may be utilized to couple wearable band 100 to an additional component (e.g., electronic device, watch housing, and so on).

Additionally, tapered portion 126 may include a diverging or widening taper. In a non-limiting example, and distinct from FIG. 1, tapered portion 126 may include a portion of woven material 106 that may diverge and/or may have a width greater than the width of the uniform width portions 128 of wearable band 100.

Woven material 106 forming wearable band 100 may be formed form a large piece of woven material 106 that may be substantially cut or shaped to a desired size. In a non-limiting example, woven material 106 may be cut from a larger piece of woven material 106 to form wearable band 100 using a laser cutting process. The laser used in the laser cutting process may substantially cut the woven material 106 to a desired dimension of wearable band 100 from the larger piece of woven material. Additionally, the laser in the laser cutting process may simultaneously cauterize and/or round the edges of woven material 106 forming wearable band 100 to prevent fraying of woven material 106. Although discussed herein as being laser cut, it is understood that woven material 106 may undergo any suitable cutting or shearing process to form wearable band 100.

Additionally, the laser cutting process may also form woven material 106 to include second end 112 that may be secured to the remaining portion of wearable band 100 without altering the cosmetic appearance and/or geometry of woven material 106 and/or wearable band 100. That is second end 112 may be cut to include a specific geometry during the laser cutting process, such that when coupled or secured to wearable band 100 and/or retention loop 124, second end 112 is cosmetically and/or geometrically similar to the remaining portion of woven material 106. As discussed herein, the weave pattern, and ultimately the dimensions, of woven material 106 may be altered in areas of woven material 106 that may be cut when forming wearable band 100.

Although shown as two distinct portions, it is understood that wearable band 100 may be formed from a single piece of woven material 106. In one non-limiting example, the single piece of woven material 106 forming wearable band 100 may have elastic properties, such that the wearable band 100 may be a single, continuous loop of woven material 106 and may stretch around a user's wrist. In another non-limiting example, the single piece of woven material 106 forming wearable band 100 may have a loop component positioned on end 110 that may receive end 112, and end 112 may be subsequently folded back onto and coupled to portions of wearable band 100 to secure wearable band 100 to a user's wrist. In this non-limiting example, end 112 and/or at least a portion of wearable band 100 contacting end 112 may include any suitable coupling component or feature that may couple end 112 to wearable band 100 including, but not limited to, Velcro, magnets, clips and so on.

Additionally, although discussed herein as being formed from a large piece of woven material 106, it is understood that wearable band 100 may be formed by weaving threads to size. That is, and in a non-limiting example, wearable band 100 may not be cut from a larger piece of woven material 106, but rather woven material 106 may be woven to a desired size of wearable band 100, and may not undergo a cutting process, as discussed herein. However, in the non-limiting example where wearable band 100 is formed from woven material 106 woven to size, the ends of woven material 106 may undergo additional processes, for example melting and/or pinching, to improve physical characteristics, and/or visual and/or tactile features.

Figure 2:
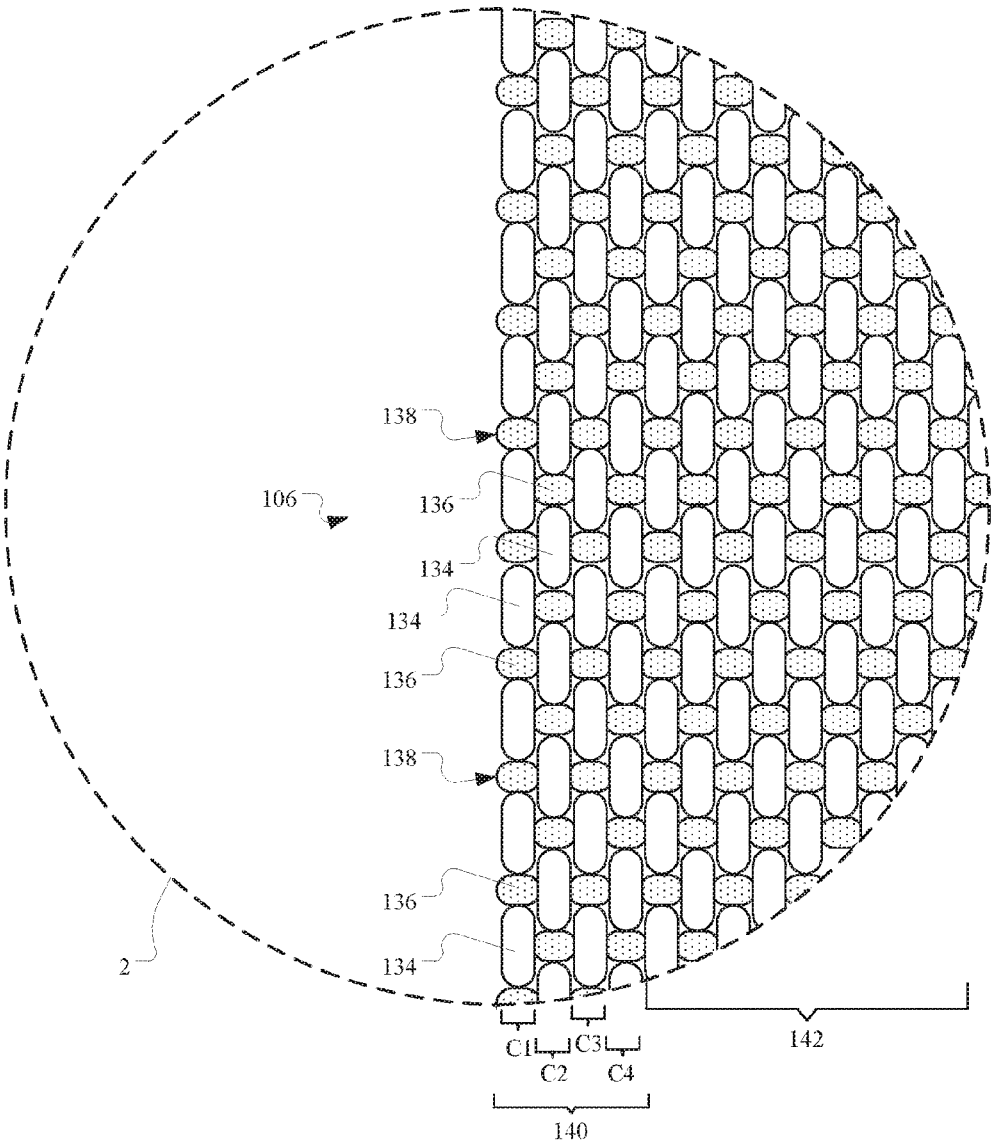
FIG. 2 depicts an enlarged view of a uniform width portion of the wearable band formed from the woven material of FIG. 1, according to embodiments.

FIG. 2 shows an enlarged view of a portion of uniform width portion 128 of wearable band 100 of FIG. 1. As shown in FIG. 2, and discussed in detail herein, woven material 106 forming wearable band 100 (see, FIG. 1) may be formed from a plurality of warp threads 134, and at least one weft thread 136 coupled to the warp threads 134. The plurality of warp threads 134 may be positioned or extend along a length of wearable band 100 (e.g., between first end 110 and second end 112), and at least one weft thread 136 positioned perpendicular to, and coupled to, woven or interlaced between the plurality of warp threads 134. As discussed in detail herein, woven material 106 may be formed from a plurality of distinct layers of warp threads 134 (see, FIGS. 3A-3C), where weft thread 136 is coupled to, woven or interlaced between each of the distinct layers of the plurality of warp threads 134.

In the non-limiting example shown in FIG. 2, the plurality of warp threads 134 may continuously alternate position, and/or may alternate between being positioned above and below weft thread 136. Weft thread 136 may be coupled to, woven or interlaced between the plurality of warp threads 134. This weave pattern shown in FIG. 2, and discussed herein with respect to FIGS. 3A-3C, may be considered a first weave pattern for woven material 106. Woven material 106, as discussed herein, may be formed using any suitable weaving technique and/or weaving machinery. In a non-limiting example, woven material 106 may be formed using a dobby loom.

Warp threads 134 and the weft thread 136 may be formed from any suitable material capable of being coupled, woven or interlaced with each other to form woven material 106. In a non-limiting example, warp threads 134 and weft thread 136 of woven material 106 may be formed from or include a polyamide (e.g., nylon) material, a polyester material, thermoplastic polyethylene (e.g., Dyneema) or a polypropylene material. Warp threads 134 and weft thread 136 of woven material 106 may also be formed from any other suitable polymer material that may include similar physical characteristics as polyester and/or polypropylene. Warp threads 134 and weft thread 136 may be formed from the same material or may be formed from distinct materials when forming woven material 106.

It is understood that the number of threads shown in FIG. 2 to form woven material 106 may be merely exemplary, and may not represent the actual number of warp threads and/or weft threads used to form woven material 106. In a non-limiting example, woven material 106 may be formed from more than 200 warp threads and a single weft thread coupled to, woven or interlaced between the plurality of warp threads. In another non-limiting example, the at least one weft thread 136 may be formed from a single thread that may be continuously woven between warp threads 134, or may be formed from a plurality of threads that may be woven between warp threads 134. In conjunction, the spacing between the warp threads and/or weft threads as shown in FIG. 2 may also be merely exemplary for the purpose of clearly and completely describing woven material 106. It is understood that the space between the threads of woven material 106 may only be large enough to couple and/or weave at least one weft thread through the plurality of warp threads (e.g., 200 warp threads) to form woven material 106. Additionally, the spacing between the threads of woven material 106 may be substantially minimal such that a user may not be able to see through woven material 106.

The weave pattern for forming woven material 106 may result in ribs 138 formed on the exterior of woven material 106. In the non-limiting example shown in FIG. 2, ribs 138 may be represented by the "bump," or protrusion formed by the weft thread 136, and/or the surface-level change between warp thread 134 and weft thread 136. Ribs 138 may be formed on the edge of the entire woven material 106 forming wearable band 100, including both uniform width portion 128, as shown in FIG. 2, and in tapered width portion 126, discussed herein.

As shown in FIG. 2, woven material 106, formed from warp threads 134 and weft thread(s) 136, may be further identified by distinct portions or columns of warp threads 134. In a non-limiting example, the plurality of warp threads 134 of woven material 106 may include two distinct groups of outer columns 140 (one shown) of warp threads 134, and a group of inner columns 142 of warp threads 134 positioned between the two distinct groups of outer columns 140 of warp threads 134. Inner columns 142 of warp threads 134 may make up the majority of the body portion or center of woven material 106, and outer columns 140 may form the edge portion of woven material 106. In the non-limiting example shown in FIG. 2, outer columns 140 of warp threads 134 may be formed from four distinct columns (C1-C4) of warp threads 134. The first column (C1) and third column (C3) of warp threads 134 may have a similar weave pattern for warp threads 134 and weft thread 136. Additionally, the second column (C2) and fourth column (C4) of warp threads 134 may have a similar weave pattern for warp threads 134 and weft thread 136. The weave pattern for warp threads 134 of the first column (C1) and third column (C3), may be distinct and/or opposite the weave pattern for warp threads 134 of the second column (C2) and fourth column (C4).

It is understood that the number of columns of warp threads 134 included in the outer columns 140 and/or the inner columns 142 of warp threads 134, as shown in FIG. 2, may be merely exemplary, and may not represent the actual number of columns of warp threads 134 included in each portion of woven material 106. In a non-limiting example, outer columns 140 of warp threads 134 may include only two distinct columns of warp threads 134, or may include more than four distinct columns of warp threads 134. Additionally, as the number of columns of warp threads 134 included in outer columns 140 increases, the number of inner columns 142 of warp threads 134 may decrease, and vice versa.

Figure 3A:
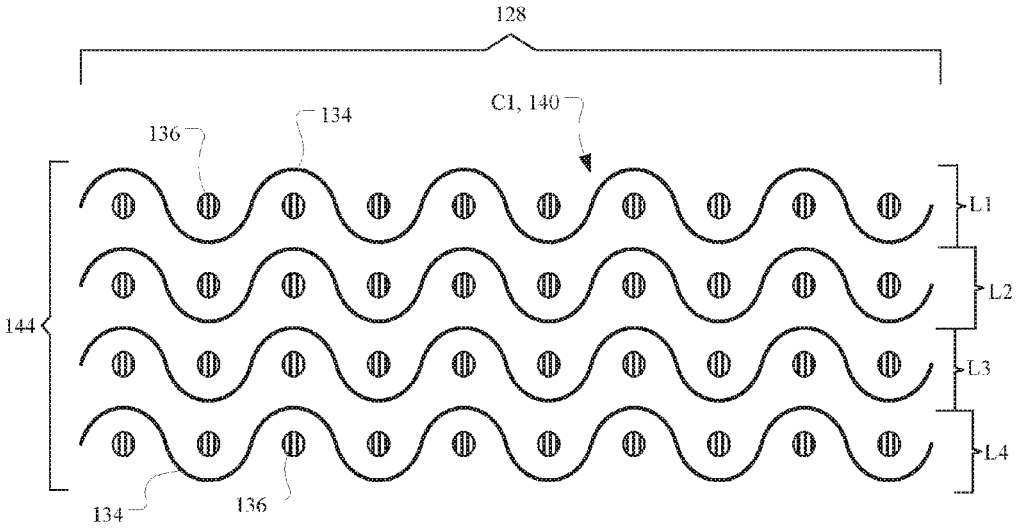
FIGS. 3A-3C depict side cross-section views of the woven material in the uniform width portion of the wearable band, taken along line UP-UP of FIG. 1, according to embodiments.
Figure 3B:
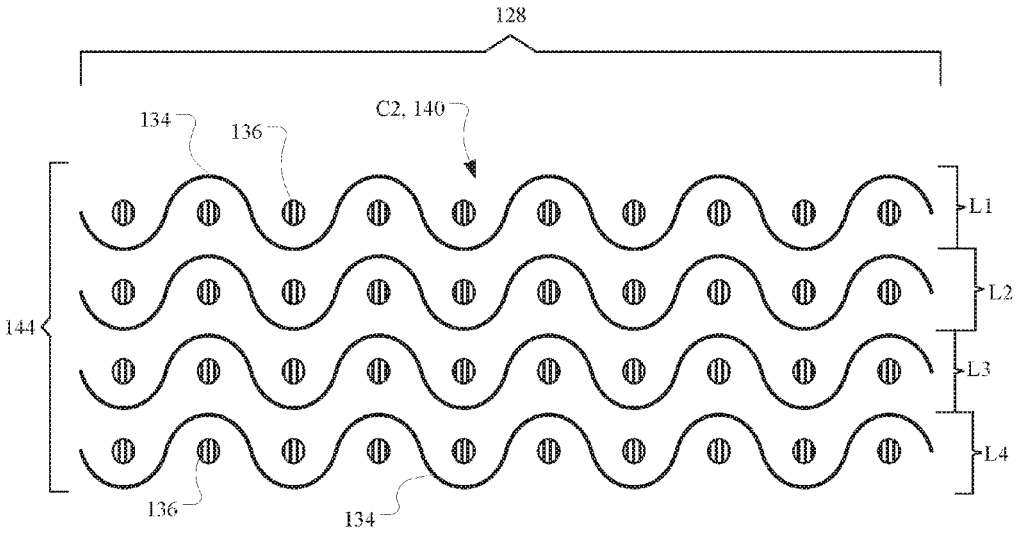
Figure 3C:
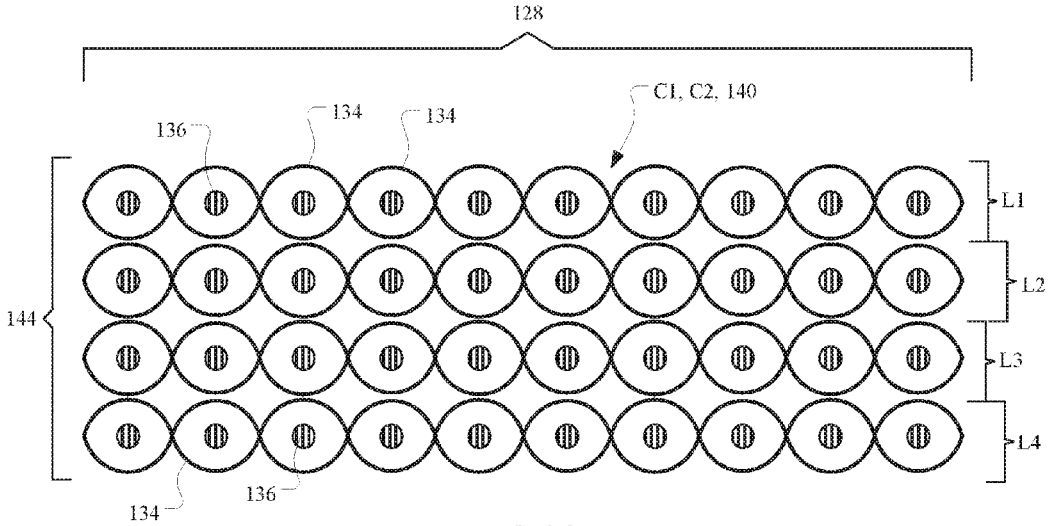

FIGS. 3A-3C show side cross-section views of the portion of uniform width portion 128 of wearable band 100, taken along line UP-UP of FIG. 1. In a non-limiting example, FIG. 3A shows a side cross-section view of warp threads 134 of first column (C1) of outer columns 140 formed in woven material 106. In an additional non-limiting example, FIG. 3B shows a side cross-section view of warp threads 134 of second column (C2) of outer columns 140 formed in woven material 106. FIG. 3C depicts both warp threads 134 of first column (C1) and second column (C2) of outer columns 140 as shown in FIGS. 3A and 3B. It is understood that similarly numbered and/or named components may function in a substantially similar fashion. Redundant explanation of these components has been omitted for clarity.

Woven material 106 may include a plurality of distinct layers of warp threads 134. In the non-limiting examples shown in FIGS. 3A-3C, woven material 106 may be formed from four distinct layers (L1-L4) of a plurality of warp threads 134. The first layer (L1) of warp threads 134 may form a top surface of woven material 106. The second layer (L2) of warp threads 134 may be positioned adjacent the first layer (L1) of warp threads 134, and the third layer (L3) of warp threads 134 may be positioned adjacent the second layer (L2). The second layer (L2) and third layer (L3) of warp threads 134 may collectively form the inner or interior layers of woven material 106. Additionally, the warp threads 134 of the second layer (L2) and the third layer (L3) may not be visible to a user of wearable band 100 (see, FIG. 1) formed from woven material 106. The fourth layer (L4) of warp threads 134 may be positioned adjacent the third layer (L3) of warp threads 134. The fourth layer (L4) may form a bottom surface of woven material 106, opposite the top surface formed by the first layer (L1).

In a first weave pattern 144 for woven material 106, at least one weft thread 136 may be positioned between the plurality of warp threads 134 in the first layer (L1), the second layer (L2), the third layer (L3) and the fourth layer (L4). In the non-limiting example shown in FIGS. 3A-3C, weft thread 136 may be woven through and/or interlaced between all four layers of warp threads 134, over or across the entire length of woven material 106. Although single weft thread 136 is discussed, it is understood that a plurality of weft threads may be used when forming woven material 106. That is, in a non-limiting example, each layer (L1-L4) of warp threads 134 may include an individual or distinct weft thread 136.

Additionally in first weave pattern 144, warp threads 134 may continuously alternate position, and/or may alternate between being positioned above and below weft thread 136. The position of each warp thread 134 with respect to weft thread 136 in woven material 106 may be distinct from the warp thread 134 positioned in an adjacent column. In the non-limiting example shown in FIG. 3A, the warp thread 134 in first column (C1) may initially be positioned above weft thread 136 and may alternate between being positioned above and below weft thread 136 over the length of woven material 106. Distinct from FIG. 3A, warp thread 134 in second column (C2), as shown in FIG. 3B, may initially be positioned below weft thread 136 and may alternate between being positioned above and below weft thread 136 over the length of woven material 106; opposite to warp thread 134 of first column (C1). When viewed together, as shown in FIG. 3C, two columns of warp threads 134 (e.g., first column (C1), second column (C2)) of a portion of woven material 106 may initially have one warp thread 134 positioned above the weft thread 136 (e.g., first column (C1)) and one warp thread 134 positioned below the weft thread 136 (e.g., second column (C2)). Additionally as shown in FIG. 3C, the warp threads 134 in each column (e.g., first column (C1), second column (C2)) may continuously alternate positions with respect to weft thread 136 over the length of woven material 106.

It is understood that the entire woven material 106 in uniform width portion 128 of wearable band 100 may be woven using first weave pattern 144, as shown in FIGS. 3A-3C. That is, inner columns 142 of warp threads 134 may be formed using first weave pattern 144, as depicted and discussed with respect to FIGS. 3A-3C. Further, and as shown in FIGS. 3A-3C, in uniform width portion 128, all four of the distinct layers (L1-L4) may be woven using first weave pattern 144. As discussed herein, third column (C3) of warp threads 134 may be substantially similar to and/or may be formed using a similar weave pattern (e.g., first weave pattern 144) as the first column (C1) in uniform width portion 128. Furthermore, fourth column (C4) of warp threads 134 may be substantially similar to and/or may be formed using a similar weave pattern (e.g., first weave pattern 144) as the second column (C2).

Figure 4:
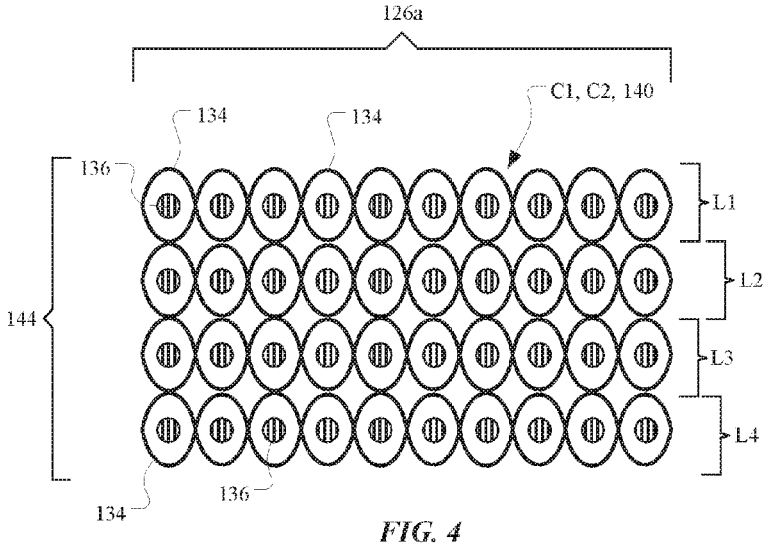
FIG. 4 depicts a side cross-section view of the woven material in the tapered width portion of the wearable band, taken along line TP-TP of FIG. 1, according to embodiments.

FIG. 4 shows a side cross-section view of the portion of tapered width portion 126*a* of wearable band 100, taken along line TP-TP of FIG. 1. In the non-limiting example, FIG. 4 shows first column (C1) and second column (C2) of outer columns 140 of warp threads 134 in tapered width portion 126*a* woven in first weave pattern 144. As similarly discussed herein, warp threads 134 of each respective column (e.g., first column (C1), second column (C2)) may alternate between being positioned above and below weft thread 136, and each warp thread 134 may be positioned in the opposite position of the warp thread 134 in the adjacent column.

In order to form tapered width portion 126*a* in woven material 106, the spacing between the warp threads 134 and/or weft threads 136 may be substantially reduced. In the non-limiting example shown in FIG. 4, and with comparison to FIG. 3C, first weave pattern 144 may be formed in tapered width portion 126*a*, however the weave pattern may be formed more tightly and the spacing between warp threads 134 and/or weft threads 136 may be reduced, creating a tighter weave pattern. The thickness and/or height of woven material 106 in tapered width portion 126*a* may not substantially increase or be larger than the thickness of woven material 106 in uniform width portion 128 (see, FIG. 3C).

However, the ribs 138 (e.g., protrusion formed by the weft threads 136, and/or the surface-level change between warp thread 134 and weft thread 136) formed in tapered portion 126*a* of woven material 106 may vary substantially more than ribs 138 formed in uniform width portion 128 (see, FIG. 3C). As shown in FIG. 4, and with comparison to FIG. 3C, ribs 138 formed in woven material 106 in tapered width portion 126*a* may include a larger height and/or distance between the peak of the rib 138 formed by warp thread 134 and the portion of woven material 106 where warp threads 134 of distinct columns pass one another between weft thread 136.

Figure 5:
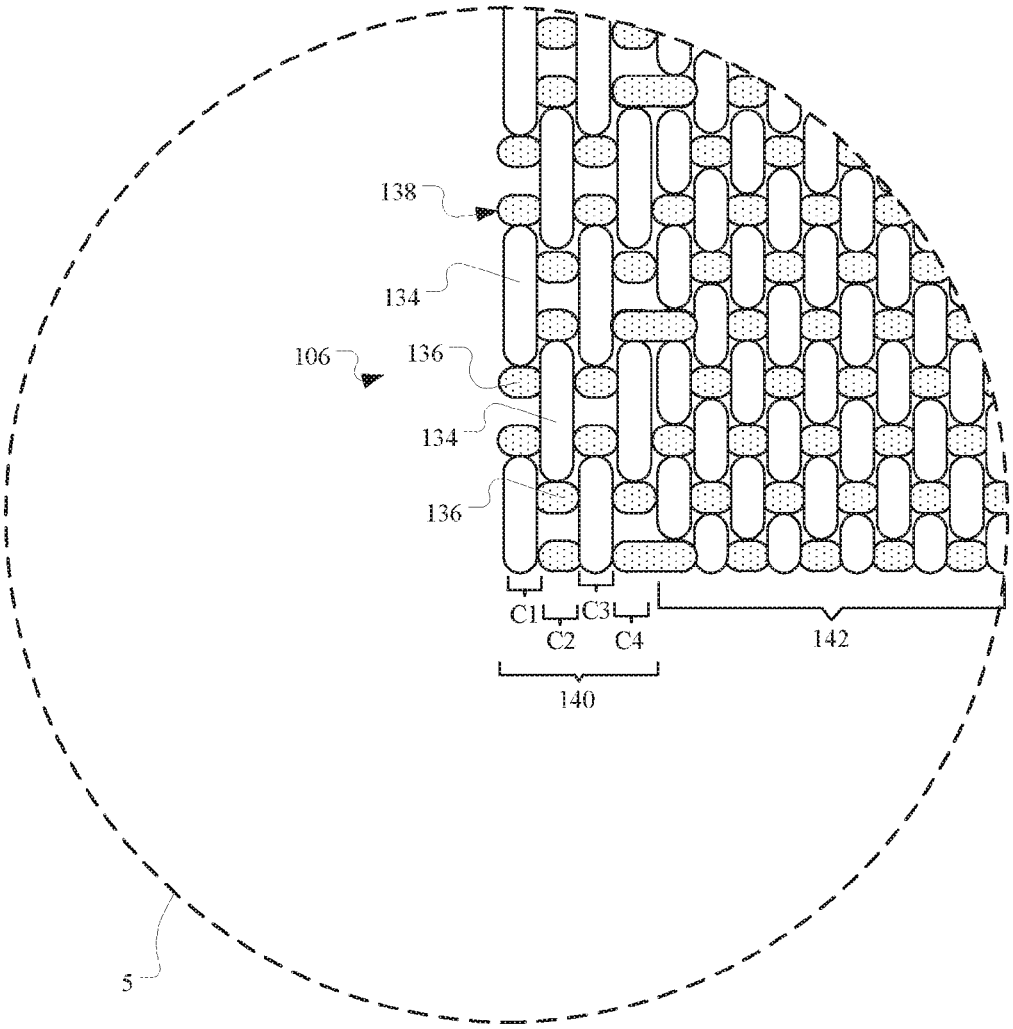
FIG. 5 depicts an enlarged view of a tapered width portion of the wearable band formed from the woven material of FIG. 1, according to embodiments.

The weave pattern of woven material 106 may be altered in tapered width portion 126 (see, FIG. 1) to modify the physical characteristics, and/or visual and/or tactile features of ribs 138 formed on the edge of woven material 106. FIG. 5 shows an enlarged view of a portion of tapered width portion 126*a* of wearable band 100 of FIG. 1. With comparison to FIG. 2, inner columns 142 of warp threads 134 may be formed using first weave pattern 144 in tapered width portion 126*a* shown in FIG. 5. First weave pattern 144 for inner columns 142 of warp threads 134 may be similar to the weave pattern of warp threads 134 discussed herein with respect to FIGS. 3A-3C. Redundant explanation of first weave pattern 144 used to form inner columns 142 of warp threads 134 of woven material 106 is omitted for clarity.

However, distinct from FIGS. 2-4, FIG. 5 shows outer columns 140 of warp threads 134 formed using a distinct, second weave pattern 146. In the non-limiting example, the four columns (C1-C4) forming outer columns 140 of warp threads 134 may be formed and/or woven using second weave pattern 146, which may be distinct from first weave pattern 144 used to form outer columns 140 and inner columns 142 in uniform width portion 128, and inner columns 142 in tapered width portion 126*a*, as discussed herein with respect to FIGS. 2-4. As discussed in detail herein, second weave pattern 146 may be formed in at least a portion of the plurality of layers (L1-L4) of warp threads 134 forming outer columns 140 of woven material 106.

Figure 6A:
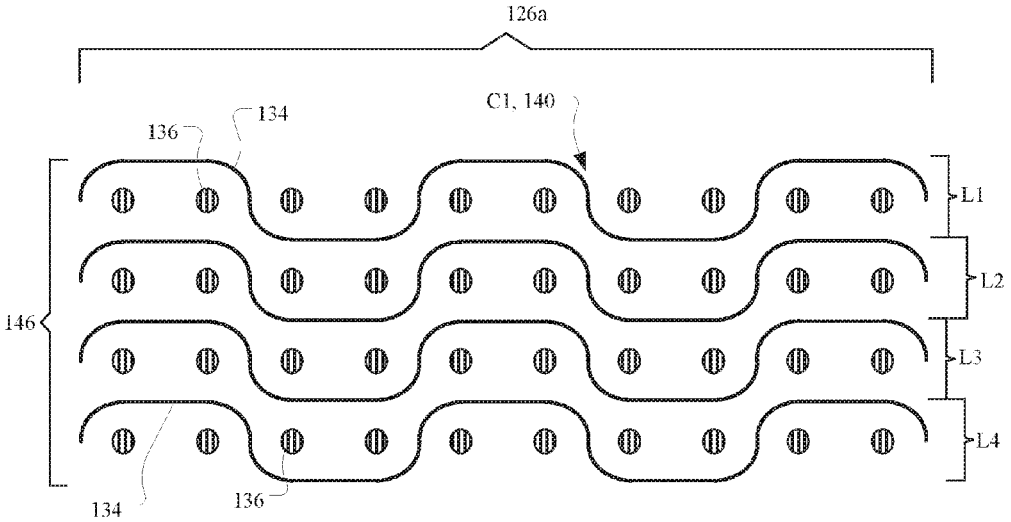
FIGS. 6A-8C depict side cross-section views of the woven material in the tapered width portion of the wearable band, taken along line TP-TP of FIG. 1, according to various embodiments.
Figure 6B:
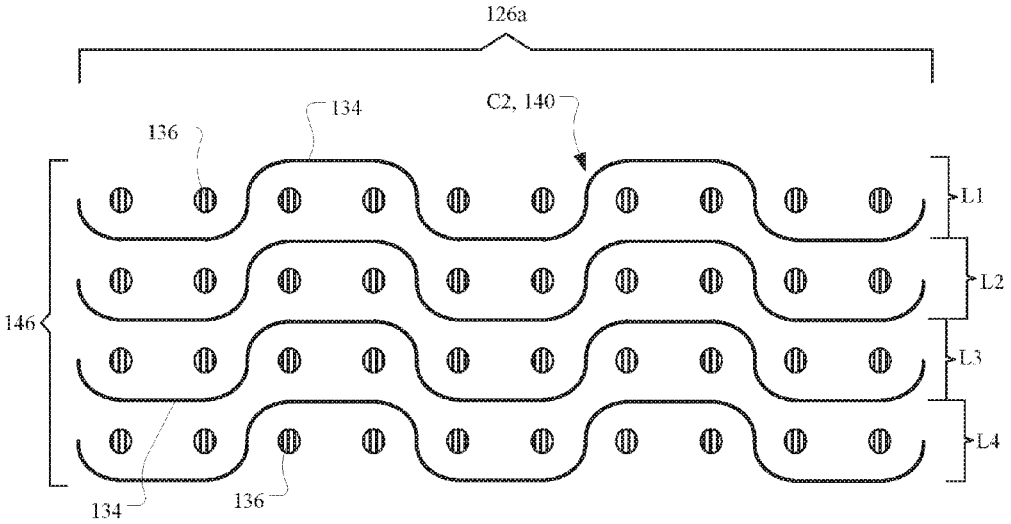
Figure 6C:
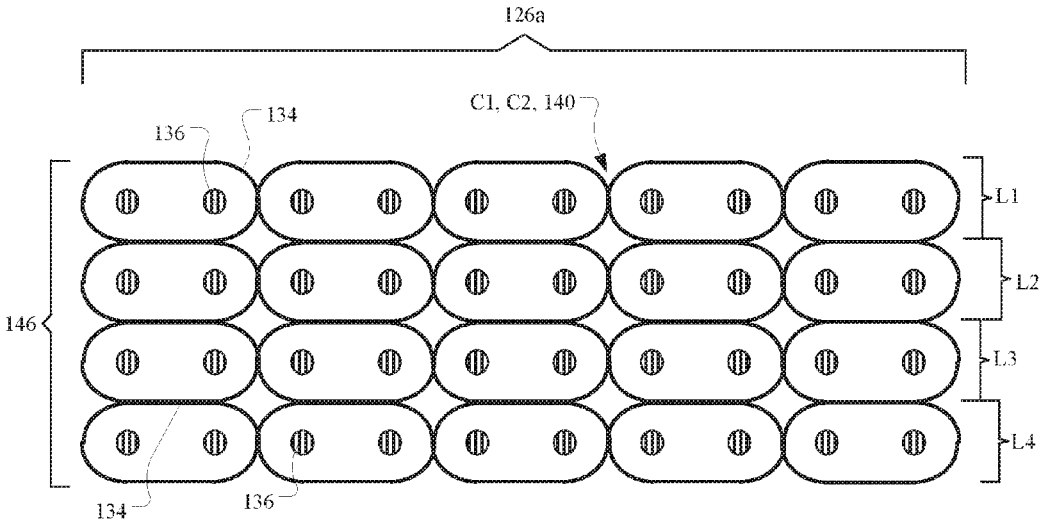

Similar to FIGS. 3A-3C, FIGS. 6A-6C show side cross-section views of the portion of tapered width portion 126*a* of wearable band 100, taken along line TP-TP of FIG. 1. In a non-limiting example, FIG. 6A shows a side cross-section view of warp threads 134 of first column (C1) of outer columns 140 in tapered width portion 126*a*. Warp threads 134 may be woven about weft thread 136 using second weave pattern 146. In an additional non-limiting example, FIG. 6B shows a side cross-section view of warp threads 134 of second column (C2) of outer columns 140 in tapered width portion 126*a*. Warp threads 134 in FIG. 6B may also be woven about weft thread 136 using second weave pattern 146. FIG. 6C depicts both warp threads 134 of first column (C1) and second column (C2) of outer columns 140 as shown in FIGS. 6A and 6B.

Second weave pattern 146 formed in outer columns 140 of woven material 106 in tapered width portion 126*a* may be distinct from first weave pattern 144 (see. FIGS. 3A-3C). When woven using second weave pattern 146, warp threads 134 in outer columns 140 may alternate between being positioned in a first position (e.g., above, below) with respect to weft thread 136 for a first predetermined length, and a second position (e.g., above, below) with respect to weft thread 136, opposite the first position, for a second predetermined length. As discussed herein, the first and second predetermined length may or may not be the same distance. In the non-limiting example shown in FIG. 6A, and with comparison to FIG. 3A, warp thread 134 of first column (C1) woven using second weave pattern 146 may be positioned above weft thread 136 and may pass over two distinct weaves of weft thread 136 (e.g., first predetermined length) over the length of woven material 106. Additionally in second weave pattern 146, warp thread 134 may be positioned below weft thread 136 and may pass under two distinct weaves of weft thread 136 (e.g., second predetermined length) over the length of woven material 106. As discussed herein, second weave pattern 146 may substantially change the pitch of warp threads 134 of woven material 106, which may in turn, effect (e.g., reduce) the size of ribs 138 formed in tapered width portion 126*a* of woven material 106.

Warp thread 134 of second column (C2), as shown in FIG. 6B, may include a similar, but opposite, weave pattern as warp thread 134 of first column (C1) (see, FIG. 6A). In the non-limiting example shown in FIG. 6B, warp thread 134 of second column (C2) formed using second weave pattern 146 may initially be positioned below weft thread 136 and may pass under two distinct weaves of weft thread 136 (e.g., first predetermined length) over the length of woven material 106. Subsequently, warp thread 134 of second column (C2) may be positioned above weft thread 136 and may pass above two distinct weavings of weft thread 136 (e.g., second predetermined length) over the length of woven material 106.

FIG. 6C shows the combination of warp threads 134 of first column (C1) and second column (C2) in tapered width portion 126 formed using second weave pattern 146. Second weave pattern 146 formed in outer columns 140 of warp threads 134 in tapered width portion 126 may form substantially smoother, flatter and/or elongated ribs 138 that may not protrude as much as the ribs 138 formed when tapered portion 126*a* of woven material 106 is formed using first weave pattern 144 (see, FIGS. 3A-4). In the non-limiting example shown in FIG. 6C, and with comparison to FIG. 4, second weave pattern 146 used to weave outer columns 140 of warp threads 134 may substantially flatten and/or reduce the size of ribs 138 formed in tapered width portion 126*a* when compared to warp threads of tapered width portion 126*a* woven using first weave pattern 144 (see, FIG. 4). As a result of smoothing, flattening and/or elongating ribs 138 formed in outer columns 140 of warp threads 134, outer columns 140 of warp threads 134 may maintain a substantially even thickness with outer columns 140 of warp threads 134 in uniform width portion 128, and inner columns 142 of warp threads in uniform width portion 128 and tapered width portion 126*a*. This may ultimately allow for wearable band 100 (see, FIG. 1) formed from woven material 106 to have a substantially even or uniform thickness, appearance, and/or tactile feature throughout wearable band 100.

It is understood, and as previously discussed herein, third column (C3) of warp threads 134 may be substantially similar to and/or may be formed using a similar weave pattern (e.g., second weave pattern 146) as the first column (C1) in uniform width portion 128. Furthermore, fourth column (C4) of warp threads 134 may be substantially similar to and/or may be formed using a similar weave pattern (e.g., second weave pattern 146) as the second column (C2).

As discussed herein, second weave pattern 146 used in tapered width portion 126*a* of woven material 106 may be formed in at least a portion of the four distinct layers (L1-L4) of warp threads 134 forming woven material 106. In the non-limiting example shown in FIGS. 6A-6C, all four layers (L4) of warp threads 134 in outer columns 140 may be woven using second weave pattern 146 to modify the size and/or configuration of ribs 138 formed in woven material 106 in tapered width portion 126.

In further non-limiting examples, only a portion (e.g., two layers) of the four distinct layers (L1-L4) of warp threads 134 may be formed using second weave pattern 146. FIGS. 7A-8C show additional non-limiting examples where only a portion of the distinct layers (L1-L4) of warp threads 134 forming woven material 106 may be formed using second weave pattern 146. It is understood that similarly numbered and/or named components may function in a substantially similar fashion. Redundant explanation of these components has been omitted for clarity.

Figure 7A:
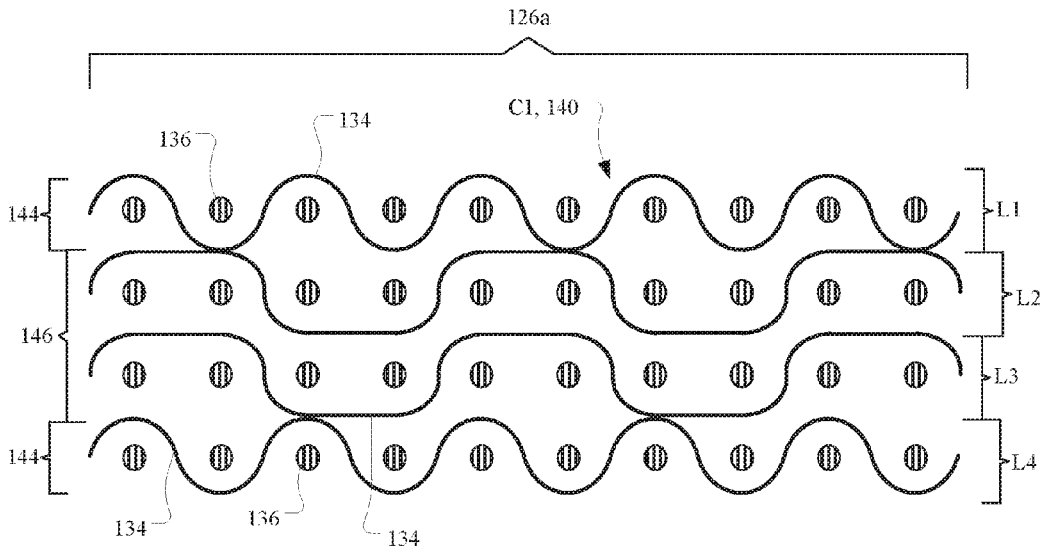
Figure 7B:
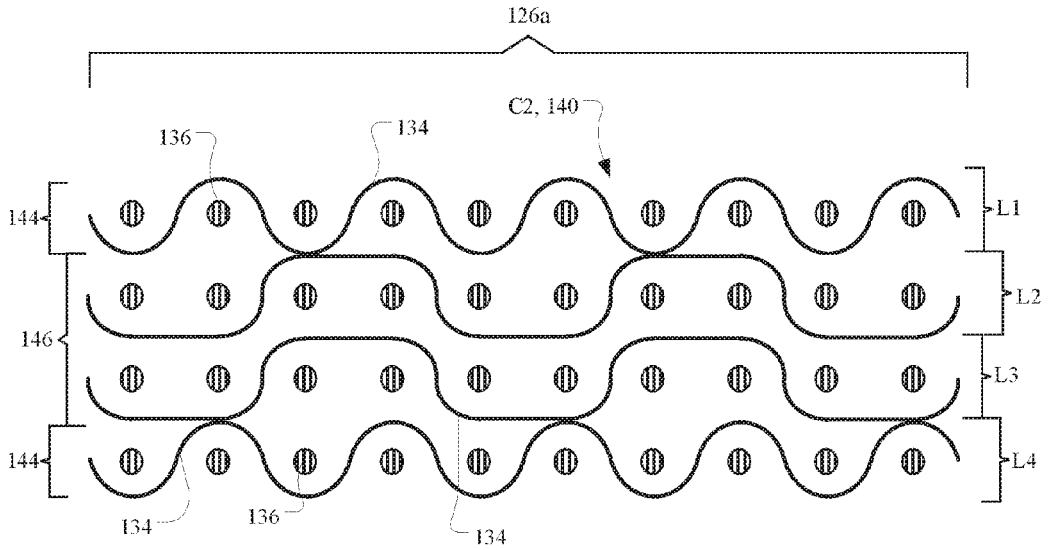
Figure 7C:
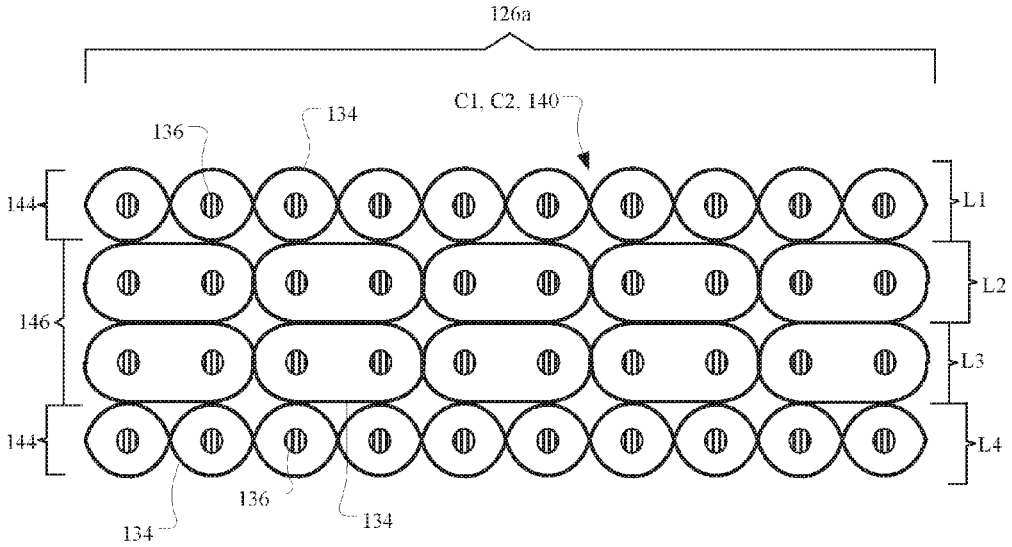

As shown in FIGS. 7A-7C, second layer (L2) and third layer (L3) of warp threads 134 in outer columns 140 of woven material 106 may be woven using second weave pattern 146. In the non-limiting example shown in FIG. 7A, warp thread 134 of first column (C1) forming second layer (L2) and third layer (L3) of woven material 106 may be formed using second weave pattern 146, as similarly discussed herein with respect to FIG. 6A. Additionally in the non-limiting example shown in FIG. 7B, warp thread 134 of second column (C2) forming second layer (L2) and third layer (L3) of woven material 106 may be formed using second weave pattern 146, as similarly discussed herein with respect to FIG. 6B.

The adjacent layers of warp threads 134 in first column (C1) and second column (C2) of outer columns 140 of warp threads 134 may be woven using first weave pattern 144. In the non-limiting example shown in FIG. 7A, warp thread 134 of first column (C1) forming first layer (L1) and fourth layer (L4) of woven material 106 may be formed using first weave pattern 144, as similarly discussed herein with respect to FIG. 3A. Additionally in the non-limiting example shown in FIG. 7B, warp thread 134 of second column (C2) forming first layer (L1) and fourth layer (L4) of woven material 106 may be formed using first weave pattern 144, as similarly discussed herein with respect to FIG. 3B.

Figure 8A:
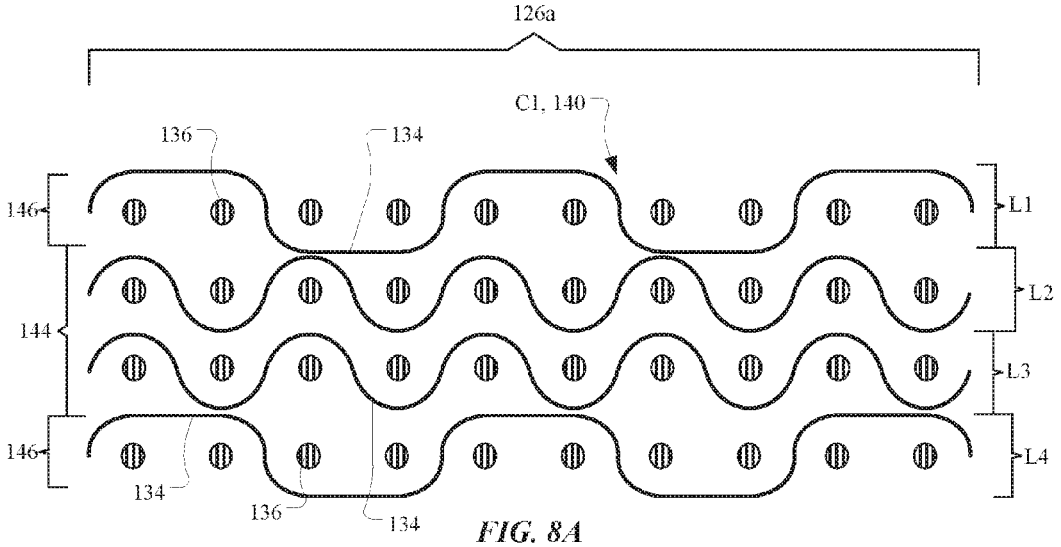
Figure 8B:
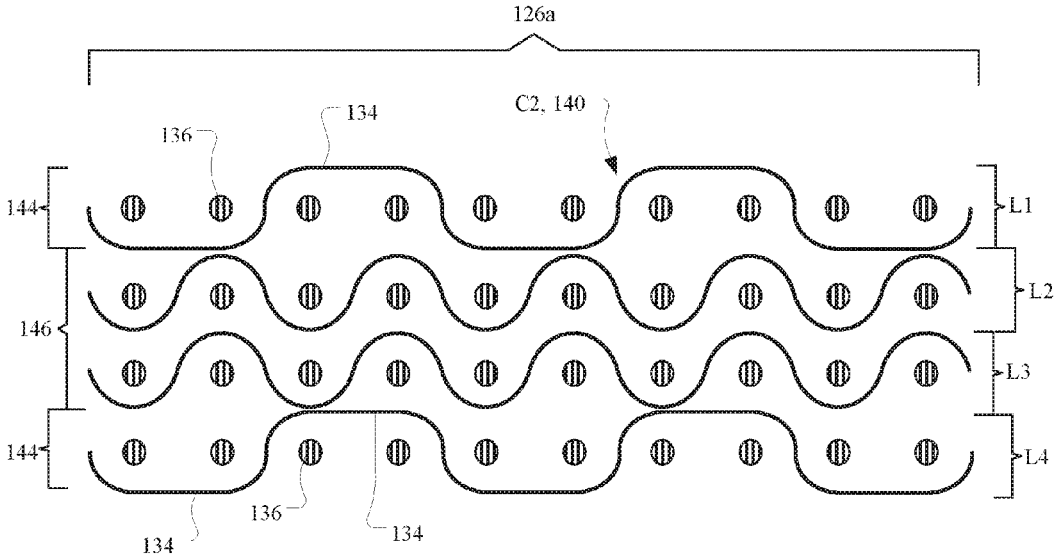
Figure 8C:
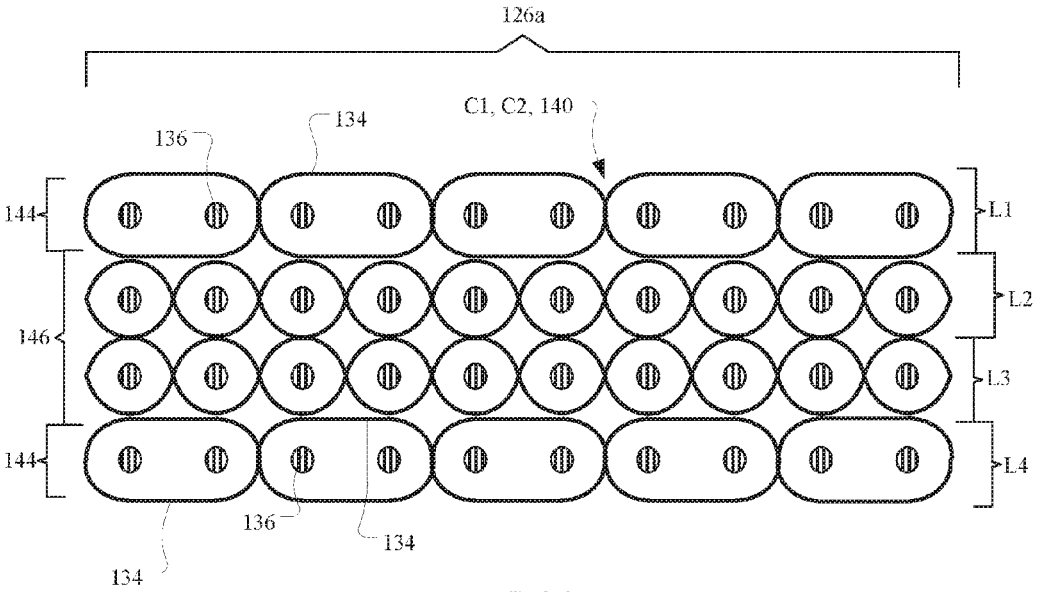

FIGS. 8A-8C show another, non-limiting example of a weave pattern form outer columns 140 of warp threads 134 in tapered width portion 126*a* of woven material 106. In the non-limiting example shown in FIG. 8A-8C, warp threads 134 of first column (C1) and second column (C2) of outer columns 140 may be formed using second weave pattern 146 in distinct layers. As shown in FIG. 8A, and distinct from FIG. 7A, warp thread 134 of first column (C1) forming first layer (L1) and fourth layer (L4) of woven material 106 may be formed using second weave pattern 146, as similarly discussed herein with respect to FIG. 6A. Additionally in the non-limiting example shown in FIG. 8B, warp thread 134 of second column (C2) forming first layer (L1) and fourth layer (L4) of woven material 106 may be formed using second weave pattern 146, as similarly discussed herein with respect to FIG. 6B.

The adjacent layers of warp threads 134 in first column (C1) and second column (C2) of outer columns 140 of warp threads 134 may be woven using first weave pattern 144. In the non-limiting example shown in FIG. 8A, warp thread 134 of first column (C1) forming second layer (L2) and third layer (L3) of woven material 106 may be formed using first weave pattern 144, as similarly discussed herein with respect to FIG. 3A. Additionally in the non-limiting example shown in FIG. 8B, warp thread 134 of second column (C2) forming second layer (L2) and third layer (L3) of woven material 106 may be formed using first weave pattern 144, as similarly discussed herein with respect to FIG. 3B.

Although only two layers of the four distinct layers (L1-L4) of warp threads 134 forming woven material 106 may be woven using second weave pattern 146, ribs 138 may be substantially effected in a similar manner as discussed herein with respect to FIG. 6C. That is, in the non-limiting examples shown in FIGS. 7C and 8C, warp threads 134 in outer columns 140 formed using second weave pattern 146 may be substantially smooth, flatten and/or may elongate ribs 138 formed in the two layers of the four distinct layers (L1-L4). This may result in a reduced overall thickness in woven material 106 because the two layers of warp threads 134 formed using second weave pattern 146 may have a reduced thickness. Similar to FIG. 6C, the reduction in thickness in the two layers of warp threads 134 formed using second weave pattern 146, and ultimately the overall thickness of woven material 106, may result in a substantially even or uniform thickness, appearance, and/or tactile feature throughout wearable band 100 formed from woven material 106.

Figure 9:
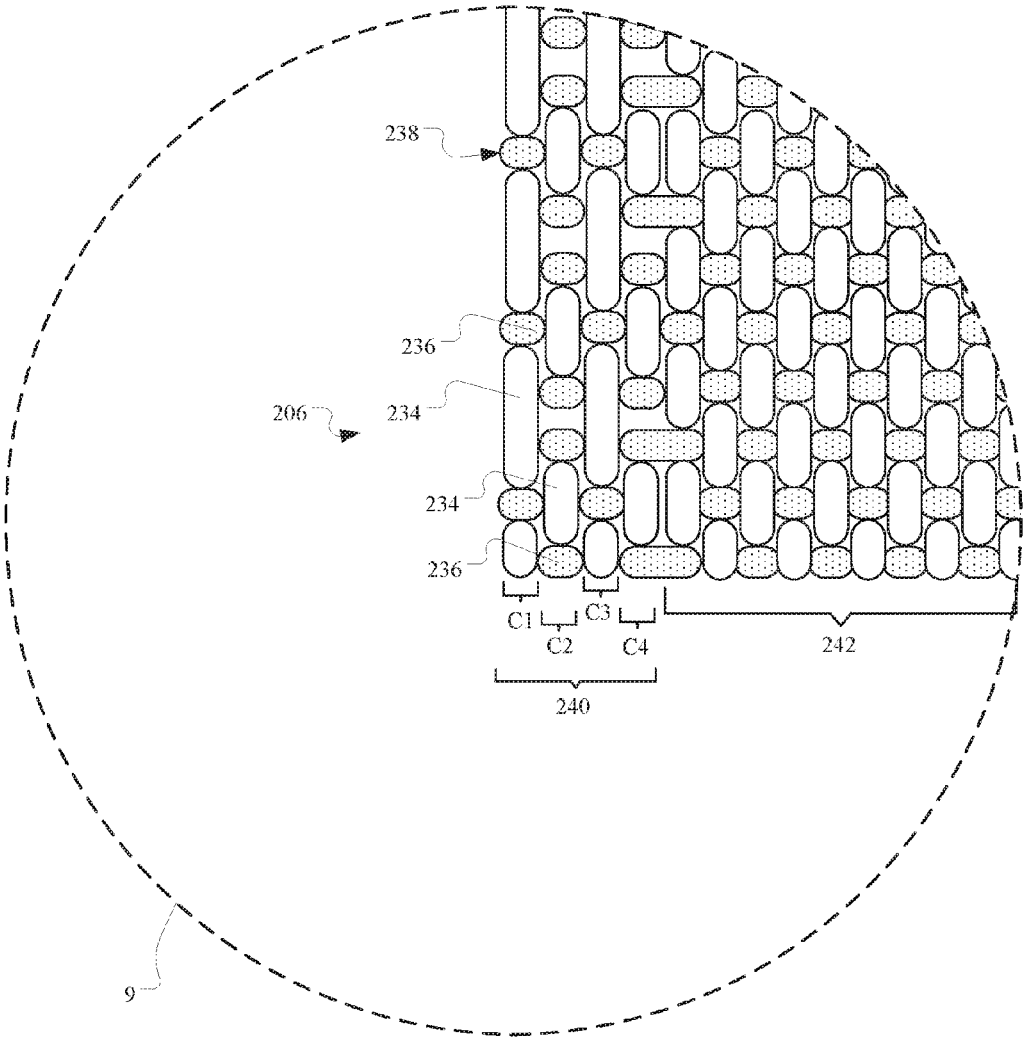
FIG. 9 depicts an enlarged view of a tapered width portion of the wearable band formed from the woven material of FIG. 1, according to additional embodiments.

FIG. 9 shows an enlarged view of a portion of tapered width portion 126*a* of wearable band 100 of FIG. 1, according to a further, non-limiting example. Similar to FIGS. 2 and 5, inner columns 242 of warp threads 234 may be formed using first weave pattern 244 in tapered width portion 126*a* shown in FIG. 9. However, distinct from FIGS. 2 and 5, FIG. 9 shows outer columns 240 of warp threads 234 formed using a distinct, second weave pattern 246. In the non-limiting example, the four columns (C1-C4) forming outer columns 240 of warp threads 234 may be formed and/or woven using second weave pattern 246, which may be distinct from first weave pattern 244 used to form outer columns 240 and inner columns 242 in uniform width portion 228, and inner columns 242 in tapered width portion 126*a*, as discussed herein (see, FIGS. 2-4). Additionally, second weave pattern 246 shown in FIG. 9 may be distinct from second weave pattern 146 discussed herein with respect to FIGS. 5-8C. Second weave pattern 246 may be formed in at least a portion of the plurality of layers (L1-L4) of warp threads 234 forming outer columns 240 of woven material 206.

Figure 10A:
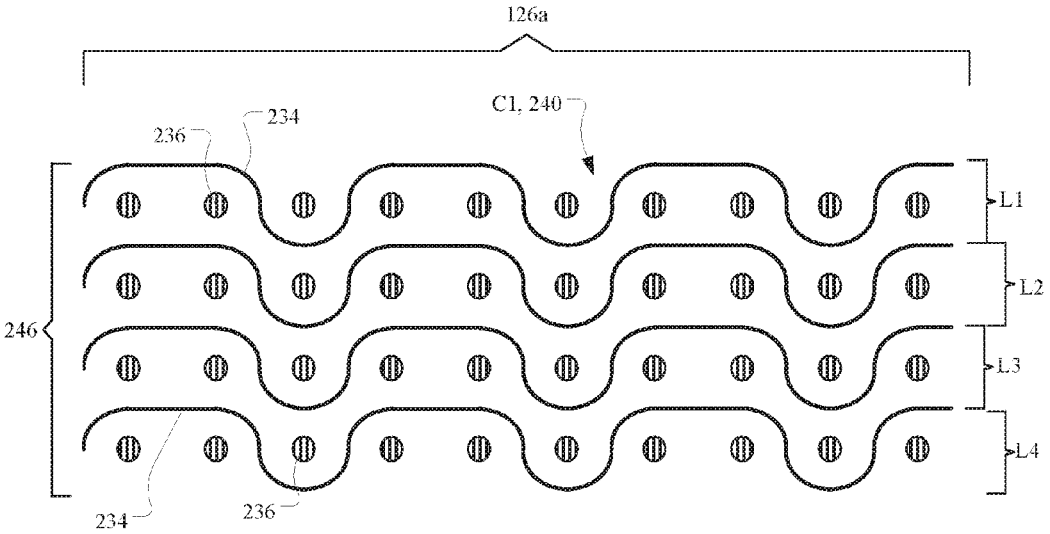
FIGS. 10A-12C depict side cross-section views of the woven material in the tapered width portion of the wearable band, taken along line TP-TP of FIG. 1, according to additional embodiments.
Figure 10B:
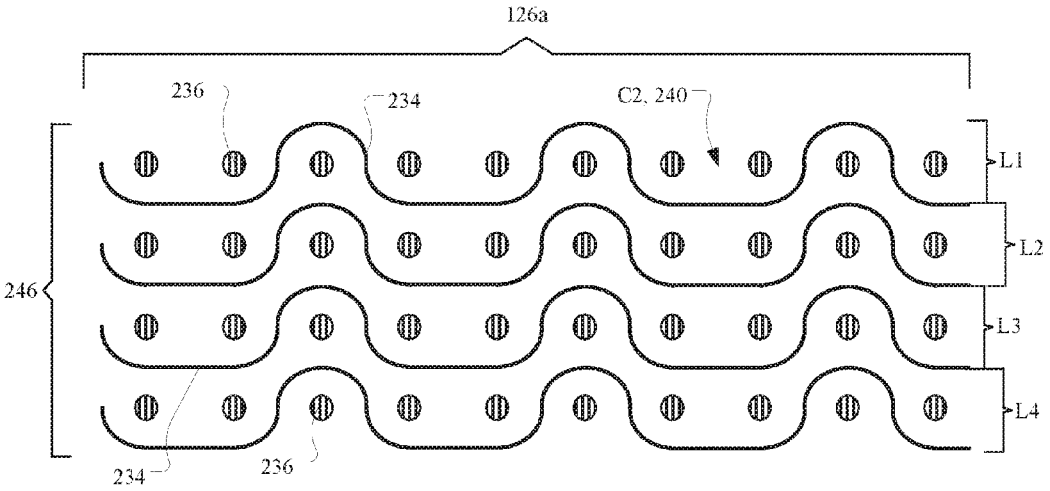
Figure 10C:
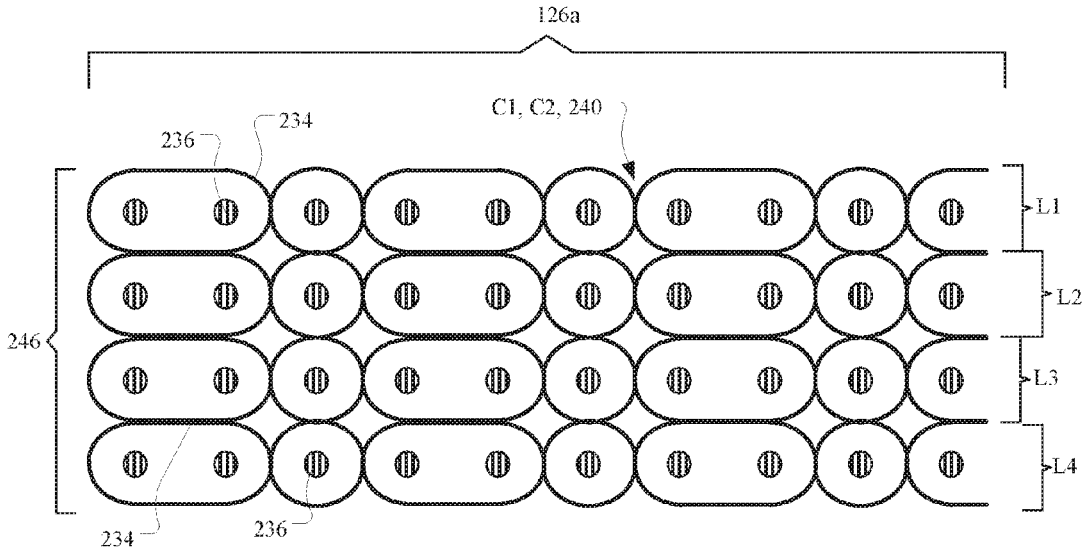

Similar to FIGS. 6A-8C, FIGS. 10A-10C show side cross-section views of the portion of tapered width portion 126*a* of wearable band 100, taken along line TP-TP of FIG. 1. In a non-limiting example, FIG. 10A shows a side cross-section view of warp thread 234 of first column (C1) of outer columns 240 in tapered width portion 126*a*. Warp thread 234 may be woven about weft thread 236 using second weave pattern 246. In an additional non-limiting example, FIG. 10B shows a side cross-section view of warp thread 234 of second column (C2) of outer columns 240 in tapered width portion 126*a*. Warp thread 234 in FIG. 10B may also be woven about weft thread 236 using second weave pattern 246. FIG. 10C depicts both warp threads 234 of first column (C1) and second column (C2) of outer columns 240 as shown in FIGS. 10A and 10B.

Second weave pattern 246 formed in outer columns 240 of woven material 206 in tapered width portion 126*a* may be distinct from first weave pattern 144 (see. FIGS. 3A-3C) and second weave pattern 146 (see, FIGS. 6A-8C). When woven using second weave pattern 246, warp threads 234 in outer columns 240 may alternate between being positioned in a first position (e.g., above, below) with respect to weft thread 236 for a first predetermined length, and a second position (e.g., above, below) with respect to weft thread 236, opposite the first position, for a second predetermined length. In the non-limiting example shown in FIG. 10A, and with comparison to FIG. 6A, warp thread 234 of first column (C1) woven using second weave pattern 246 may be positioned above weft thread 236 and may pass over two distinct weaves of weft thread 236 (e.g., first predetermined length) over the length of woven material 206. In second weave pattern 246, warp thread 234 may be positioned below weft thread 236 and may pass under a single weave of weft thread 236 (e.g., second predetermined length) over the length of woven material 206. As discussed herein, second weave pattern 246 may substantially change the pitch of warp threads 234 of woven material 206, which may in turn, effect (e.g., reduce) the size of ribs 238 formed in tapered width portion 126*a* of woven material 206.

Warp thread 234 of second column (C2), as shown in FIG. 10B, may include a similar, but opposite, weave pattern as warp thread 234 of first column (C1) (see, FIG. 10A). In the non-limiting example shown in FIG. 10B, warp thread 234 of second column (C2) formed using second weave pattern 246 may initially be positioned below weft thread 236 and may pass over two distinct weaves of weft thread 236 (e.g., first predetermined length) over the length of woven material 206. Subsequently, warp thread 234 of second column (C2) may be positioned above weft thread 236 and may pass over a single weave of weft thread 236 (e.g., second predetermined length) over the length of woven material 206.

In the non-limiting example shown in FIG. 10C, and as similarly discussed herein with respect to FIG. 6C, second weave pattern 246 used to weave outer columns 240 of warp threads 234 may substantially flatten and/or reduce the size of ribs 238 formed in tapered width portion 126*a*. As a result of smoothing, flattening and/or elongating ribs 238 formed in outer columns 240 of warp threads 234, outer columns 240 of warp threads 234 may maintain a substantially even thickness with outer columns 240 of warp threads 234 in uniform width portion 128, and inner columns 242 of warp threads 234 in uniform width portion 128 and tapered width portion 126*a* (see, FIGS. 3A-3C). This may ultimately allow for wearable band 100 (see, FIG. 1) formed from woven material 206 to have a substantially even or uniform thickness, appearance, and/or tactile feature throughout wearable band 100.

In further non-limiting examples, and similarly discussed herein with respect to FIGS. 7A-8C, only a portion (e.g., two layers) of the four distinct layers (L1-L4) of warp threads 234 forming woven material 206 may be formed using second weave pattern 246. FIGS. 11A-12C show additional non-limiting examples where only a portion of the distinct layers (L1-L4) of warp threads 234 forming woven material 206 may be formed using second weave pattern 246.

Figure 11A:
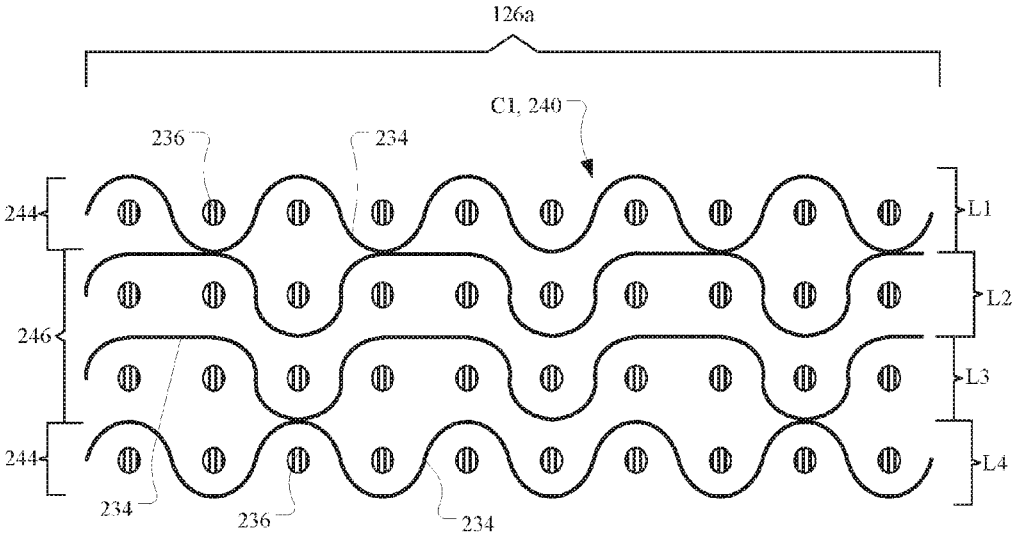
Figure 11B:
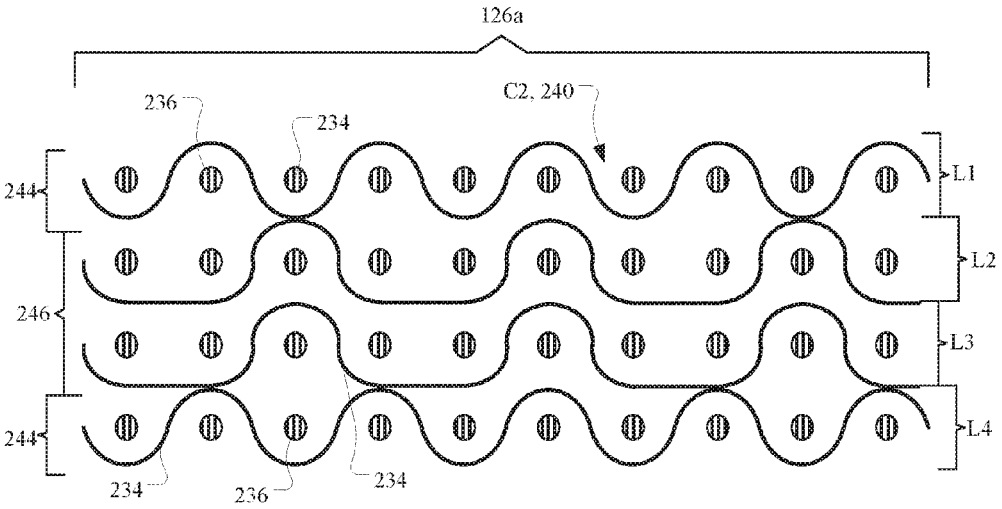
Figure 11C:
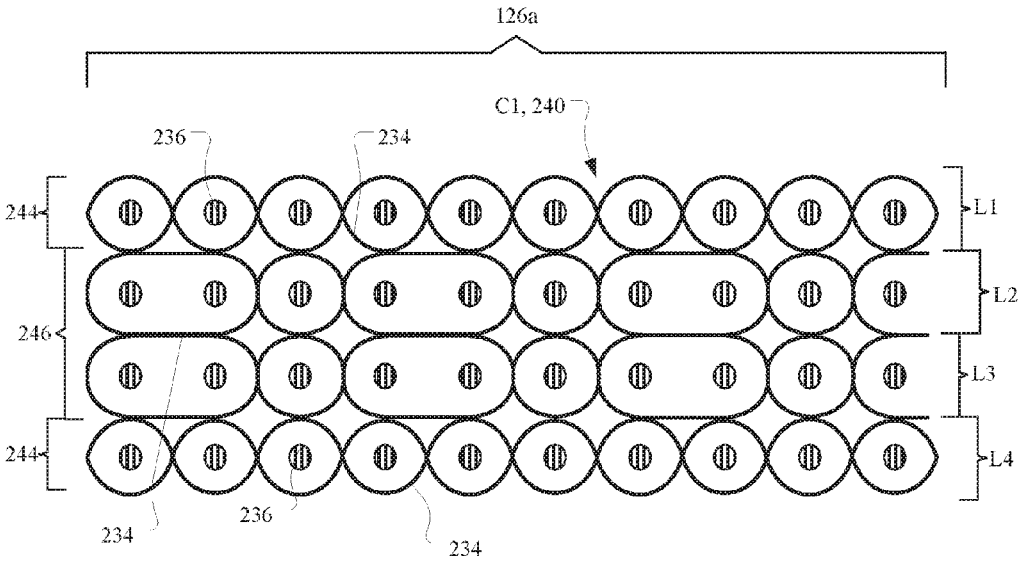

As shown in FIGS. 11A-11C, second layer (L2) and third layer (L3) of warp threads 234 in outer columns 240 may be woven using second weave pattern 246. In the non-limiting example shown in FIG. 11A, warp thread 234 of first column (C1) forming second layer (L2) and third layer (L3) of woven material 206 may be formed using second weave pattern 246, as similarly discussed herein with respect to FIG. 10A. Additionally in the non-limiting example shown in FIG. 11B, warp thread 234 of second column (C2) forming second layer (L2) and third layer (L3) of woven material 206 may be formed using second weave pattern 246, as similarly discussed herein with respect to FIG. 10B.

The adjacent or distinct layers of warp threads 234 in first column (C1) and second column (C2) of outer columns 240 may be woven using first weave pattern 244. In the non-limiting example shown in FIG. 11A, warp thread 234 of first column (C1) forming first layer (L1) and fourth layer (L4) of woven material 206 may be formed using first weave pattern 244, as similarly discussed herein with respect to FIG. 3A. Additionally in the non-limiting example shown in FIG. 11B, warp thread 234 of second column (C2) forming first layer (L1) and fourth layer (L4) of woven material 206 may be formed using first weave pattern 244, as similarly discussed herein with respect to FIG. 3B.

Figure 12A:
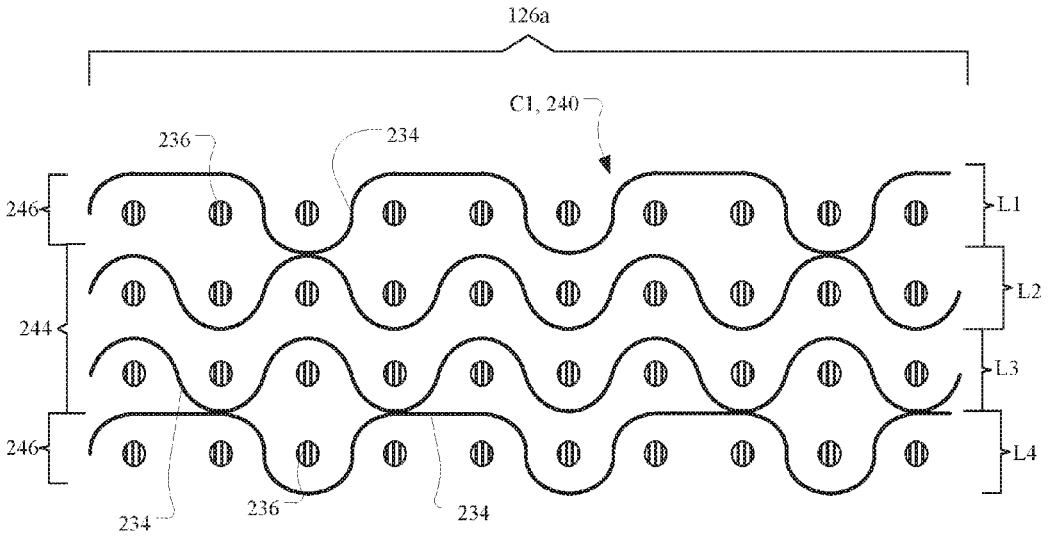
Figure 12B:
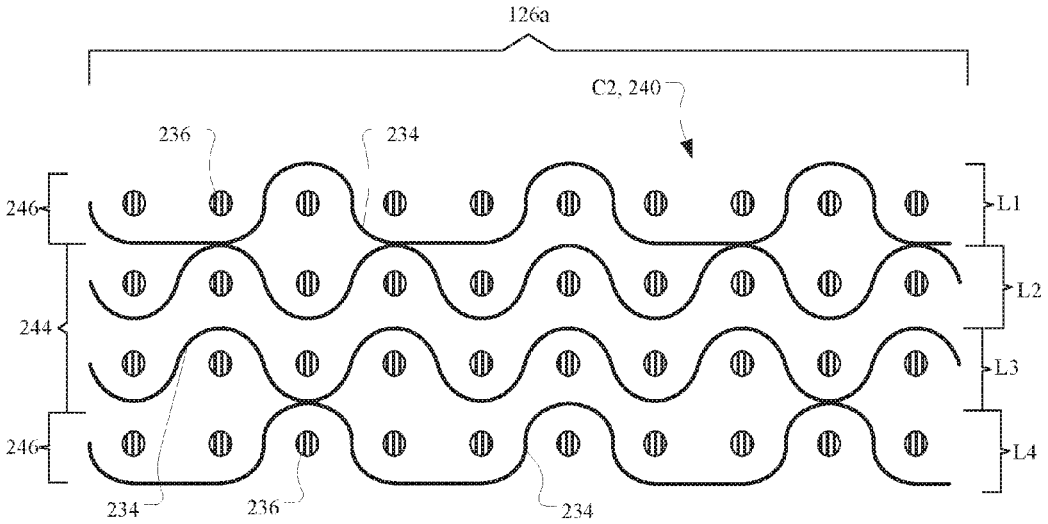
Figure 12C:
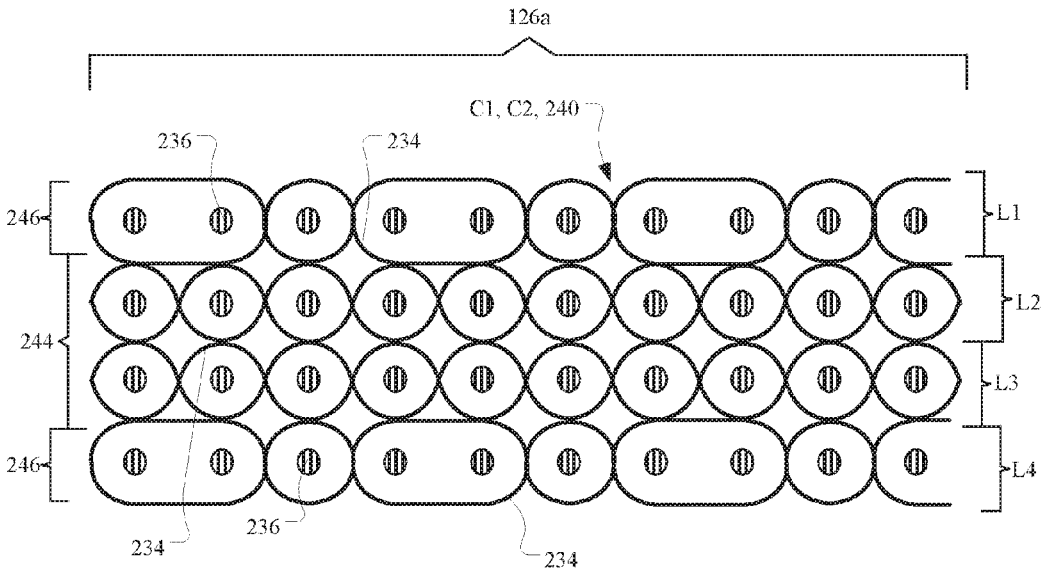

FIGS. 12A-12C show another, non-limiting example of a weave pattern for outer columns 240 of warp threads 234 in tapered width portion 126*a* of woven material 206. In the non-limiting example shown in FIG. 12A-12C, warp threads 234 of first column (C1) and second column (C2) of outer columns 240 may be formed using second weave pattern 246 in distinct layers. As shown in FIG. 12A, and distinct from FIG. 11A, warp thread 234 of first column (C1) forming first layer (L1) and fourth layer (L4) of woven material 206 may be formed using second weave pattern 246, as similarly discussed herein with respect to FIG. 10A. Additionally in the non-limiting example shown in FIG. 12B, warp thread 234 of second column (C2) forming first layer (L1) and fourth layer (L4) of woven material 206 may be formed using second weave pattern 246, as similarly discussed herein with respect to FIG. 10B.

The adjacent or distinct layers of warp threads 234 in first column (C1) and second column (C2) of outer columns 240 may be woven using first weave pattern 244. In the non-limiting example shown in FIG. 12A, warp thread 234 of first column (C1) forming second layer (L2) and third layer (L3) of woven material 206 may be formed using first weave pattern 244, as similarly discussed herein with respect to FIG. 3A. Additionally in the non-limiting example shown in FIG. 12B, warp thread 234 of second column (C2) forming second layer (L2) and third layer (L3) of woven material 206 may be formed using first weave pattern 244, as similarly discussed herein with respect to FIG. 3B.

Ribs formed in woven material may also be smoothed, flattened and/or elongated to ultimately reduce the size and/or thickness of the ribs and/or woven material, without modifying the weave pattern of the woven material. Rather the woven material forming the wearable band may include distinct fibers or material for forming at least a portion of the warp threads of the woven material to improve physical characteristics and/or visual and/or tactile features in the tapered width portions of the woven material and/or the wearable band.

Figure 13:
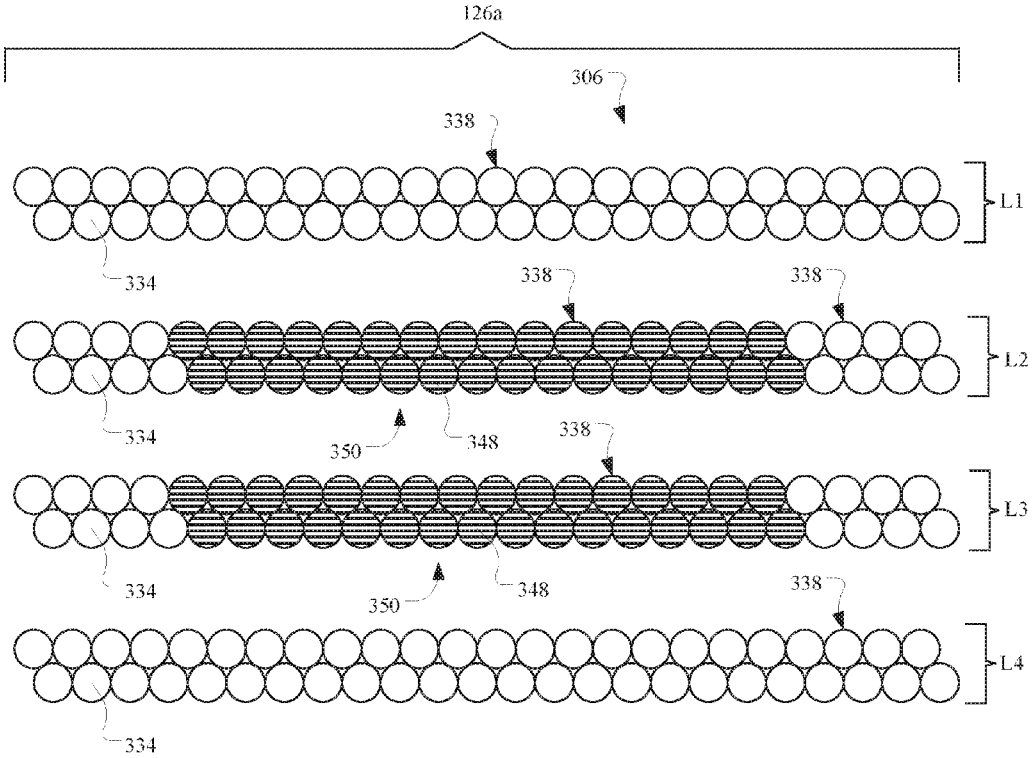
FIGS. 13-19 depict cross-section front view of the woven material in the tapered width portion of the wearable band, taken along line 13-20 of FIG. 1, according to various embodiments.

FIG. 13 shows a cross-section front view of the portion of tapered width portion 126*b* of wearable band 100, taken along line 13-20 of FIG. 1. Woven material 306 shown in FIG. 13 may be formed from the four distinct layers (L1-L4) of warp threads 334, as discussed herein with respect to FIGS. 2-12C. Weft thread 336, that may be coupled to, woven or interlaced between the plurality of warp threads 334 in each of the four distinct layers (L1-L4), may be omitted for clarity. However it is understood, and as discussed herein, that weft thread would be positioned between the two distinct, stacked groups of warp threads 334 forming each layer (L1-L4) of woven material 306. Each layer (L1-L4) of warp threads 334 may be woven using the first weave pattern 144, as discussed herein with respect to FIGS. 3A-3C. Additionally, the separation between each layer (L1-L4) of warp threads 334 forming woven material 306, as depicted in FIG. 13, may be merely illustrative for descriptive purposes, and may not necessarily represent the spacing between each layer (L1-L4) of warp threads 334. As similarly discussed and shown herein with respect to FIGS. 3A-3C, each layer (L1-L4) of warp threads 334 in woven material 306 may be positioned directly adjacent and/or substantially contacting one another when forming woven material 306.

Woven material 306 may also be formed using a plurality of elastic fibers 348. In the non-limiting example shown in FIG. 13, at least a portion of warp threads 334 in at least one of the plurality of layers (L1-L4) forming woven material 306 may be formed from elastic fibers 348. Elastic fibers 348 may be formed in woven material 306 over the entire length of woven material 306 forming wearable band 100 (see, FIG. 1) and/or may replace at least a portion of warp threads 334 in at least one layer (L1-L4) of woven material 306. In the non-limiting example, elastic fibers 348 may be formed in a portion of and/or may replace a portion of warp threads 334 of second layer (L2) and third layer (L3) of woven material 306. As shown in FIG. 13, elastic fibers 348 formed in second layer (L2) and third layer (L3) may be formed in a centralized portion of woven material 306, and may be positioned between warp threads 334 formed on an outer portion of second layer (L2) and third layer (L3). As a result, elastic fibers 348 may not be visible to a user of wearable band 100 (see, FIG. 1) that is formed from woven material 306. Elastic fibers 348 may be woven in a substantially similar manner as warp threads 334 (e.g., first weave pattern 144 of FIGS. 3A-3C) throughout wearable band 100 (e.g., uniform width portion 128, tapered width portion 126*b*).

Elastic fibers 348 may be formed from any suitable material that may include substantially elastic, flexible, and/or pliable characteristics. Sample materials include nylon, elastomeric fibers or threads, polyesters, spandex, olefin-based materials, wool and cotton materials (including blends thereof), and other stretch wovens.

Elastic fibers 348 formed throughout woven material 306 may be under distinct tensions in separate portions of wearable band 100 (see, FIG. 1). In a non-limiting example shown in FIG. 13, the portion of elastic fibers 348 of woven material 306 positioned in tapered width portion 126*b* may be under a localized tension 350 that may be greater than the tension of the remaining portion of elastic fibers 348 in uniform width portion 128 (see, FIG. 1). That is, elastic fibers 348 formed in uniform width portion 128 may be under a first tension, substantially similar to the tension of warp threads 334 in woven material 306, and elastic fibers 348 formed in tapered width portion 126*a*, as shown in FIG. 13, may be under a second, localized tension 350 that may be greater than the first tension of elastic fibers 348 and/or warp threads 334.

By locally increasing the tension of elastic fibers 348 in tapered width portion 126*b*, elastic fibers 348 may substantially change shape, size, dimension and/or position within woven material 306 to aid in reducing the size and/or flatten ribs 338 of woven material 306 formed in tapered portion 126*b*. In a non-limiting example, because of the elastic properties and characteristics of elastic fibers 348, the increased localized tension 350 placed on elastic fibers 348 may substantially stretch and/or reduce the circumference or thickness of elastic fibers 348, which may in turn, increase the distance between elastic fibers 348 within woven material 106. The changes to the physical characteristics (e.g., size/circumference reduction, separation, and so on) may allow for a reduced thickness and/or flattening of the peak of ribs 338 in the portion of second layer (L2) and third layer (L3) of woven material 306 formed with elastic fibers 348. That is, and as similarly discussed herein with respect to FIGS. 7A-7C and 11A-11C, the physical changes experienced by elastic fibers 348 as a result of localized tension 350 may reduce the thickness and/or flatten ribs 338 formed in second layer (L2) and third layer (L3) of woven material 306, which may ultimately allow for the adjacent layers (e.g., first layers (L1), fourth layer (L4)) to have reduced thickness and/or flattened ribs 338 as well. This may ultimately allow for wearable band 100 (see, FIG. 1) formed from woven material 306 having elastic fiber 348 to have a substantially even or uniform thickness, appearance, and/or tactile feature throughout wearable band 100.

FIGS. 14-17 show additional, non-limiting examples of woven material 306. The additional, non-limiting examples of woven material 306 shown in FIGS. 14-17 may include some similar components and/or features of woven material 306 shown in FIG. 13, and some distinct features. The distinct features, discussed in detail below, may similarly achieve a reduced thickness and/or flattening of ribs 338 in tapered width portion 126*b* of woven material 306, as similarly discussed herein with respect to FIG. 13. The reduced thickness and/or flattening of ribs 338 may allow for a substantially even or uniform thickness, appearance, and/or tactile feature throughout wearable band 100 formed from woven material 306 having elastic fibers 348.

Figure 14:
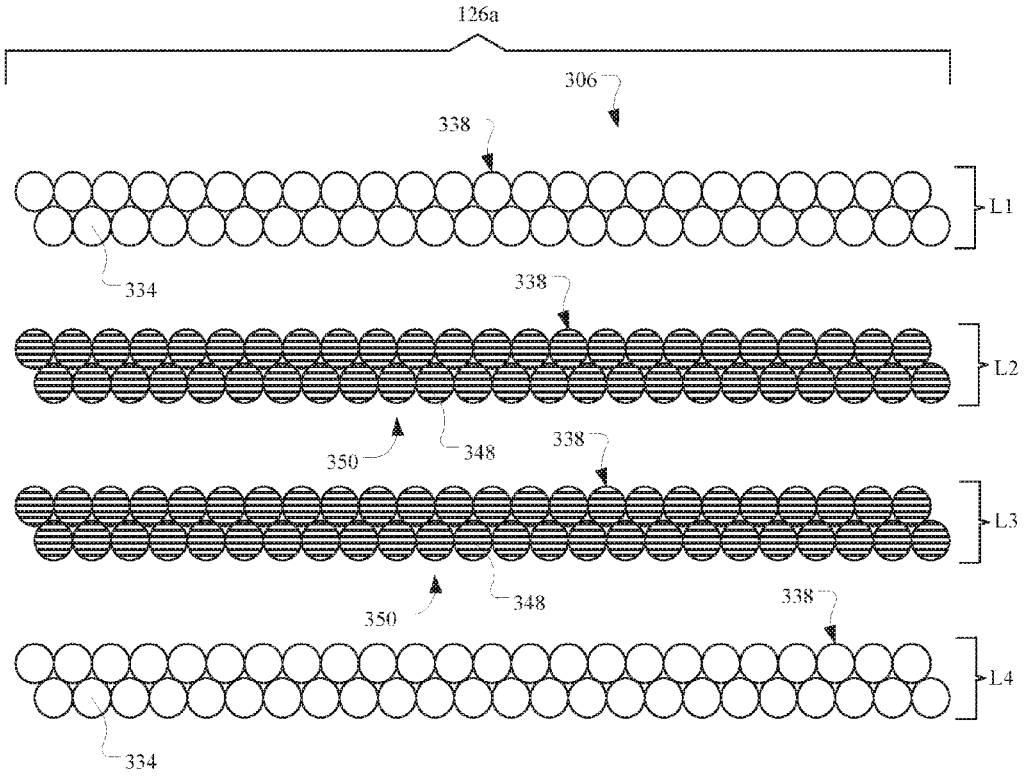

As shown in FIG. 14, and generally similar to FIG. 13, elastic fibers 348 may be formed in second layer (L2) and third layer (L3) of woven material 306. However, distinct from FIG. 13, the non-limiting example shown in FIG. 14 may have elastic fibers 348 forming the entire second layer (L2) and third layer (L3) of woven material 306. In the non-limiting example, elastic fibers 348 may completely replace warp threads 334 in second layer (L2) and third layer (L3) of woven material 306. As a result of elastic fibers 348 forming the entire second layer (L2) and third layer (L3) of woven material 306, elastic fibers 348 may be visible on the side of woven material 306. That is, a user of wearable band 100 (see, FIG. 1) formed from woven material 306 of FIG. 14 may be able to see elastic fibers 348 when looking at the side of tapered width portion 126*b*. Elastic fibers 348 may not be seen through first layer (L1) and/or fourth layer (L4) of warp threads 334 of woven material 306.

Figure 15:
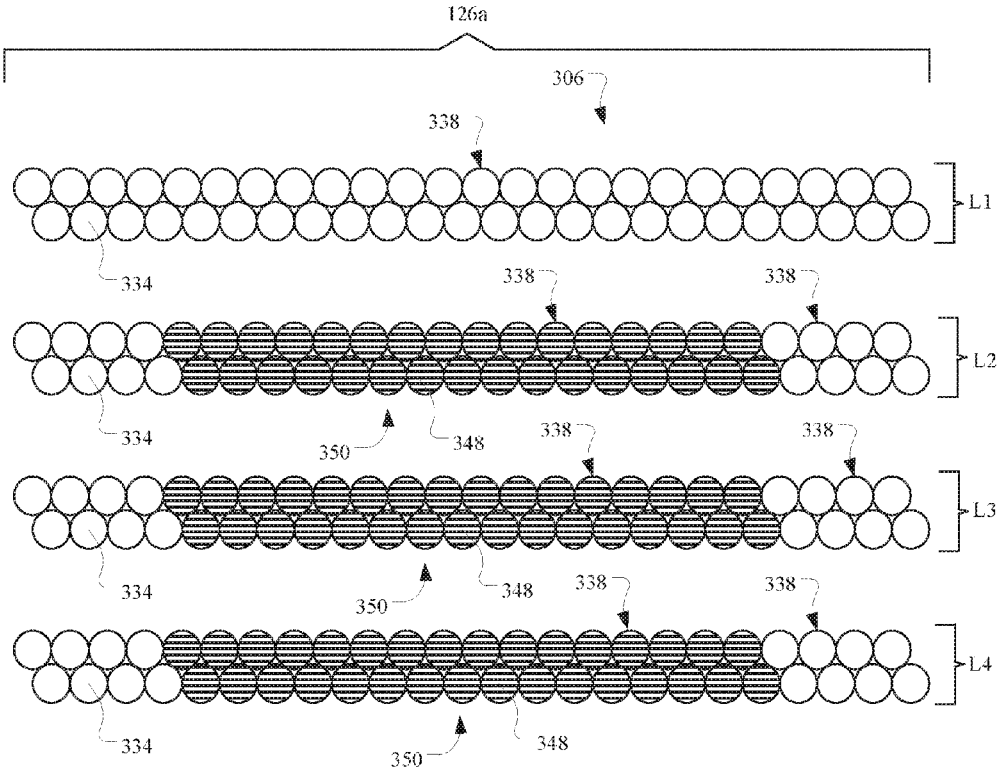

In the non-limiting example shown in FIG. 15, and similar to FIG. 13, elastic fibers 348 may be formed in a centralized portion of second layer (L2) and third layer (L3) of woven material 306. In the non-limiting example, elastic fibers 348 may also be formed in a centralized portion of fourth layer (L4) of woven material 306. Similar to FIG. 13, elastic fibers 348 formed in the centralized portion of second layer (L2), third layer (L3) and fourth layer (L4) of woven material 306 may be surrounded and/or positioned between warp threads 334, and consequently may not be visible on the side of woven material 306. However, because elastic fibers 348 are formed in a portion of fourth layer (L4) of woven material 306, elastic fibers 348 formed in fourth layer (L4) may be visible when looking at the bottom surface of woven material 306 formed by fourth layer (L4) of warp threads 334. In a non-limiting example where wearable band 100 is a watch band formed from woven material 306, the bottom surface/fourth layer (L4) of woven material 306 may be the layer that contacts a user's wrist. As such, in the non-limiting example, elastic fiber 348 formed in fourth layer (L4) may not be visible when the user is wearing wearable band 100 formed from woven material 306.

Figure 16:
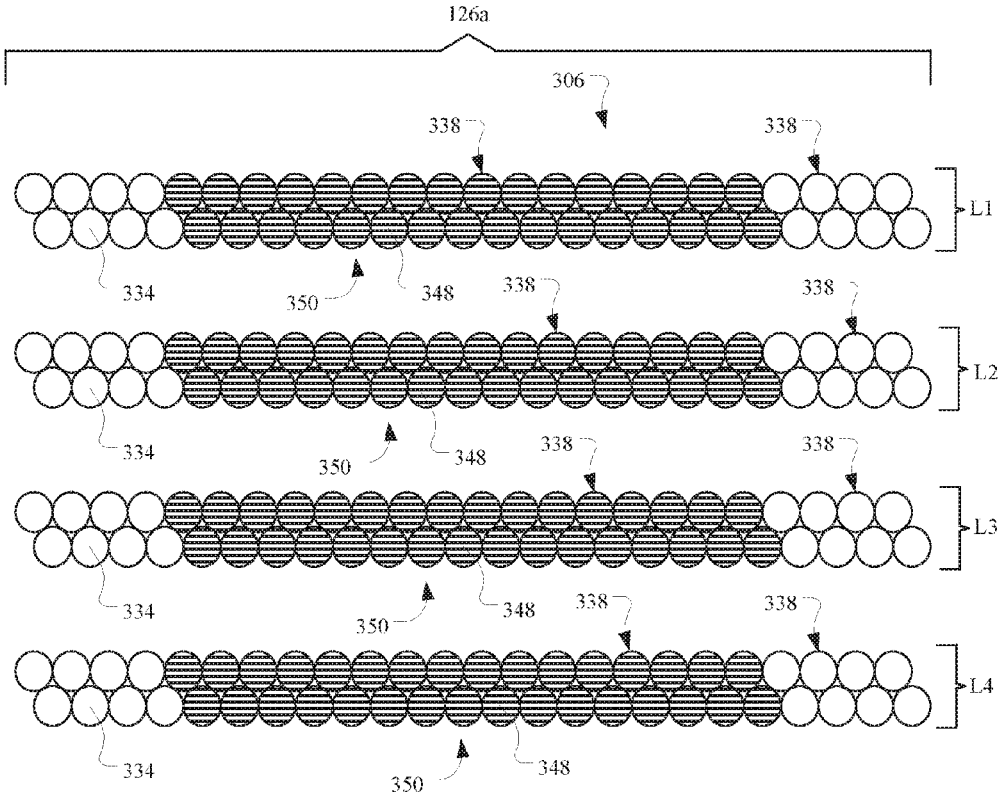

In the non-limiting example shown in FIG. 16, and similar to FIG. 15, elastic fibers 348 may be formed in a centralized portion of second layer (L2), third layer (L3) and fourth layer (L4) of woven material 306. Elastic fibers 348 may also be formed in a centralized portion of first layer (L1) of woven material 306. In the non-limiting example shown in FIG. 16, elastic fibers 348 may be formed in the centralized portion of all four distinct layers (L1-L4) of woven material 306, and elastic fibers 348 may be surrounded and/or positioned between warp threads 334. Consequently elastic fibers 348 may not be visible from the side of woven material 306. However, because elastic fibers 348 are formed in a portion of first layer (L1) and fourth layer (L4) of woven material 306, elastic fibers 348 may be visible when looking at the top surface formed by first layer (L1) and/or the bottom surface formed by fourth layer (L4) of woven material 306.

Figure 17:
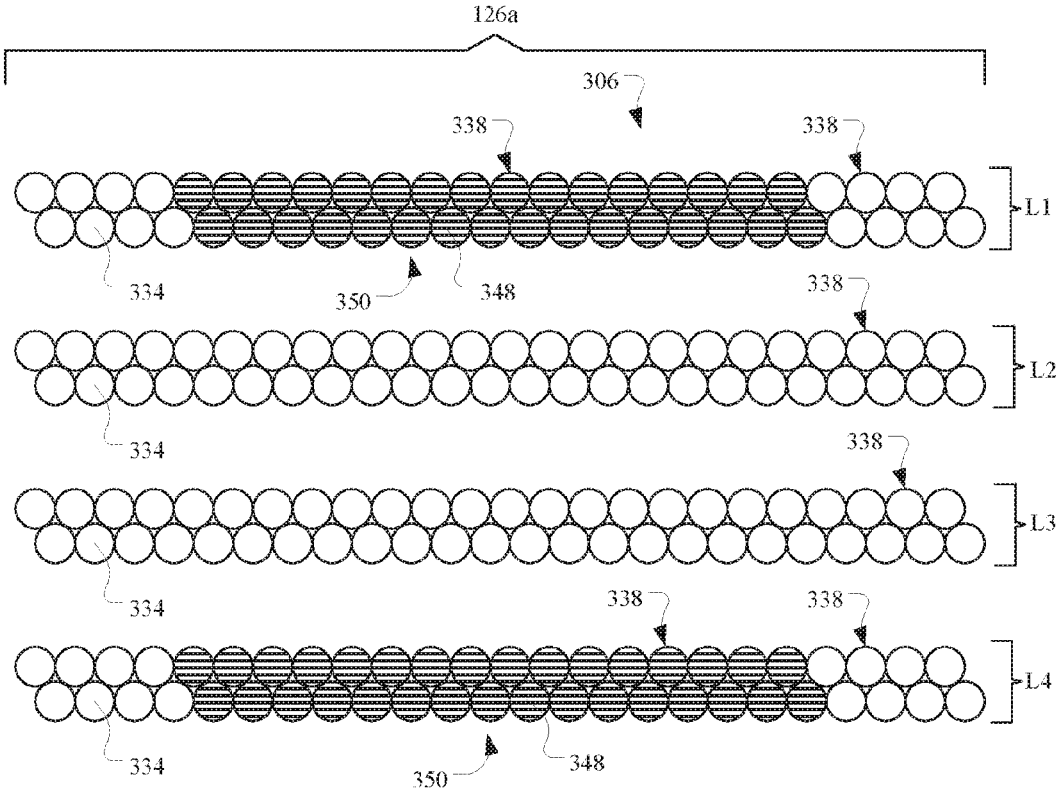

FIG. 17 shows elastic fibers 348 formed in a centralized portion of first layer (L1) and fourth layer (L4) of woven material 306. In the non-limiting example, elastic fibers 348 may be surrounded and/or positioned between warp threads 334, and may not be visible from the side of woven material 306. Similar to FIG. 16, elastic fibers 348 formed in a portion of first layer (L1) and fourth layer (L4), as shown in FIG. 17, may be visible when looking at the top surface (e.g., first layer (L1)) and bottom surface (e.g., fourth layer (L4)) of woven material 306

Although shown herein as various non-limiting examples, it is understood that woven material 306 may be formed using any combination of configurations shown and discussed with respect to FIGS. 13-17. That is, the non-limiting examples shown in FIGS. 13-17 may not include every example or configuration for incorporating elastic fibers 348 in woven material 306. For example, in an additional non-limiting example not shown, woven material 306 may include elastic fibers 348 positioned entirely in second layer (L2) and third layer (L3), as shown in FIG. 14, and elastic fibers 348 positioned in a centralized portion of fourth layer (L4), as shown in FIGS. 15-17.

Figure 18:
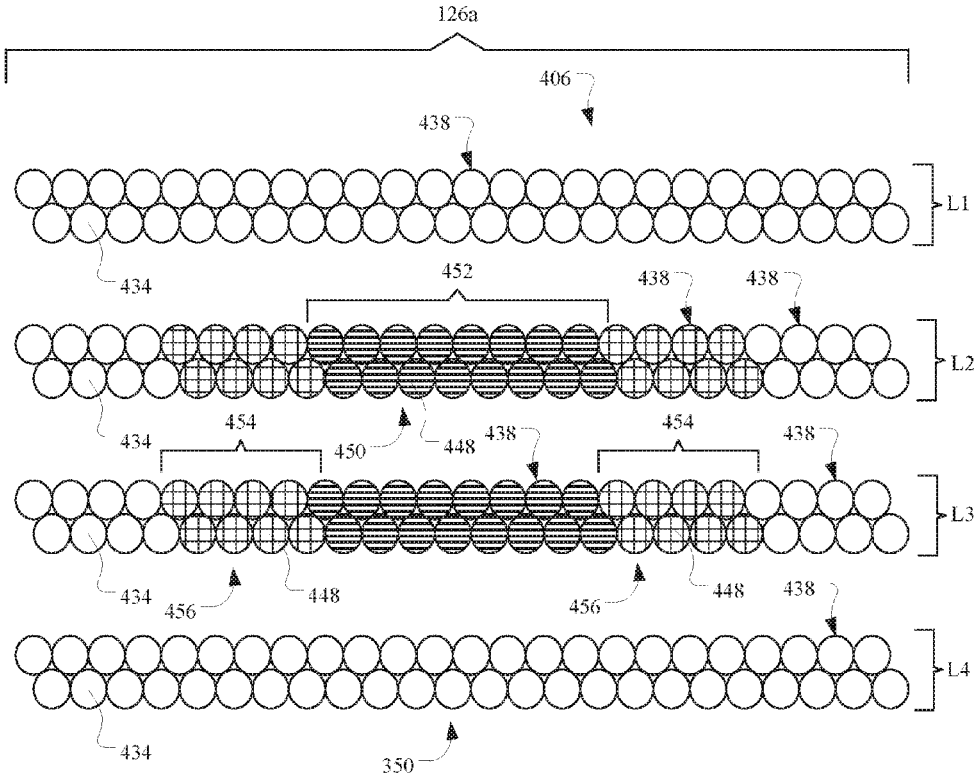
Figure 19:
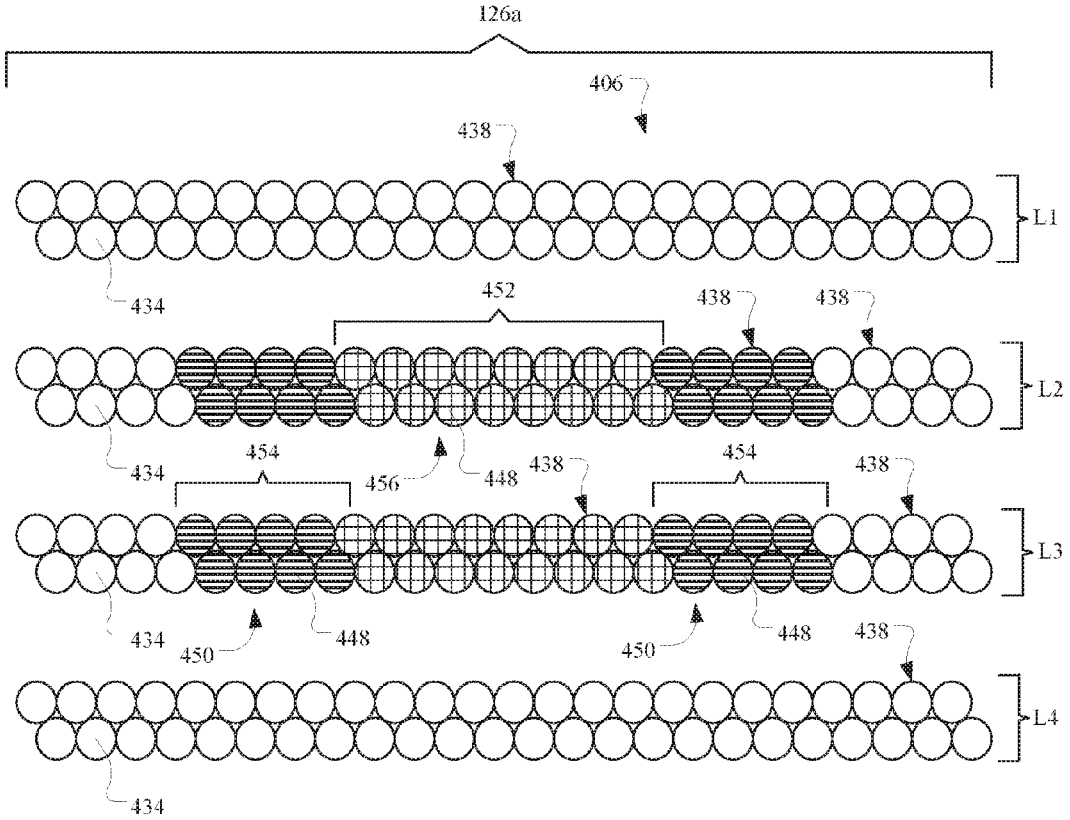

FIGS. 18 and 19 show a cross-section front view of the portion of tapered width portion 126*b* of wearable band 100, taken along line 13-20 of FIG. 1. Woven material 406 shown in FIGS. 18 and 19, may be substantially similar to woven material 306 shown in FIGS. 13-17, and may include some similar components and/or features of woven material 306. Woven material 406 shown in FIGS. 18 and 19 may also include distinct features from woven material 306. The distinct features, discussed in detail below, may similarly achieve a reduced thickness and/or flattening of ribs 438 in tapered width portion 126*b* of woven material 406, as similarly discussed herein with respect to FIGS. 13-17. The reduced thickness and/or flattening of ribs 438 may allow for a substantially even or uniform thickness, appearance, and/or tactile feature throughout wearable band 100 formed from woven material 406 having elastic fibers 448.

Woven material 406 may include elastic fiber 448 formed in at least a portion of at least one layer of the plurality of layers (L1-L4) forming woven material 406. As shown in FIG. 18, and similarly discussed herein with respect to FIG. 13, elastic fibers 448 may be formed in a centralized portion of second layer (L2) and third layer (L3) of woven material 406, and may be substantially surrounded by warp threads 434. However, distinct from FIG. 13, woven material 408 may include two distinct groups 452, 454 of elastic fibers 448. In the non-limiting example shown in FIG. 18, a first group 452 of elastic fibers 448 may be formed in second layer (L2) and third layer (L3) of woven material 306. First group 452 of elastic fibers 448 may be formed in the centralized portion of woven material 406.

Woven material 406 may also include a second group 454 of elastic fibers 448 formed in second layer (L2) and third layer (L3) of woven material 306. In the non-limiting example shown in FIG. 18, second group 454 of elastic fibers 448 may be formed as two distinct second groups 454 of elastic fibers 448 that may be positioned on opposite sides of and/or substantially surround first group 452 of elastic fibers 448. As shown in FIG. 18, warp threads 434 in second layer (L2) and third layer (L3) of woven material 406 may be positioned directly adjacent second group 454 of elastic fibers 448 and/or may substantially surround first group 452 and second group 454 of elastic fibers 448, respectively.

First group 452 and second group 454 of elastic fibers 448 formed in woven material 306 may be under distinct tensions in tapered width portion 126*b* of wearable band 100. In the non-limiting example shown in FIG. 18, first group 452 of elastic fibers 448 may be under a localized tension 450 in tapered width portion 126*b* that may be greater than the tension of elastic fibers 348 in uniform width portion 128 (see, FIG. 1) and/or the tension of warp threads 334 throughout woven material 406. Additionally in the non-limiting example, second group 454 of elastic fibers 448 may be under a distinct, localized tension 456 in tapered width portion 126*b* that may be greater than the tension of elastic fibers 348 in uniform width portion 128 (see, FIG. 1) and/or the tension of warp threads 334 throughout woven material 406, but less than the localized tension 450 of first group 452 of elastic fibers 448. That is, first group 452 of elastic fiber 448 may be under localized tension 450 in tapered width portion 126*b* that may be greater than the distinct, localized tension 456 of second group 454 of elastic fibers 448.

FIG. 19 shows an additional non-limiting example of woven material 406. As shown in FIG. 19, and compared with FIG. 18, the localized tension (e.g., tension 450, 456) of the two group 452, 454 of elastic fibers 448 may reversed. That is, in FIG. 19, first group 452 of elastic fibers 448 may be under localized tension 456, and second group 454 of elastic fibers 448 may be under localized tension 450, where localized tension 450 of second group 454 of elastic fibers 448 is greater than localized tension 456 of first group of 452 of elastic fibers 448. As similarly discussed herein with respect to FIG. 18, localized tensions 450, 456 of elastic fibers 448 (e.g., first group 452, second group 454) may be greater than the tension of elastic fibers 348 in uniform width portion 128 (see, FIG. 1) and/or the tension of warp threads 334 throughout woven material 406.

Although discussed herein as forming two distinct tensions 450, 456 on elastic fibers 448 in woven material 406, it is understood that first group 452 and second group 454 of elastic fibers 448 may be formed from distinct elastic materials, having distinct elastic properties and/or characteristics. That is, in place of forming two tensions 450, 456 on elastic fibers 448 or in conjunction with the two tensions 450, 456 placed on elastic fibers 448, first group 452 and second group 454 of elastic fibers 448 may be formed from distinct elastic materials to aid in reducing thickness and/or flattening of ribs 438 of woven material 406, as discussed herein.

Figure 20:
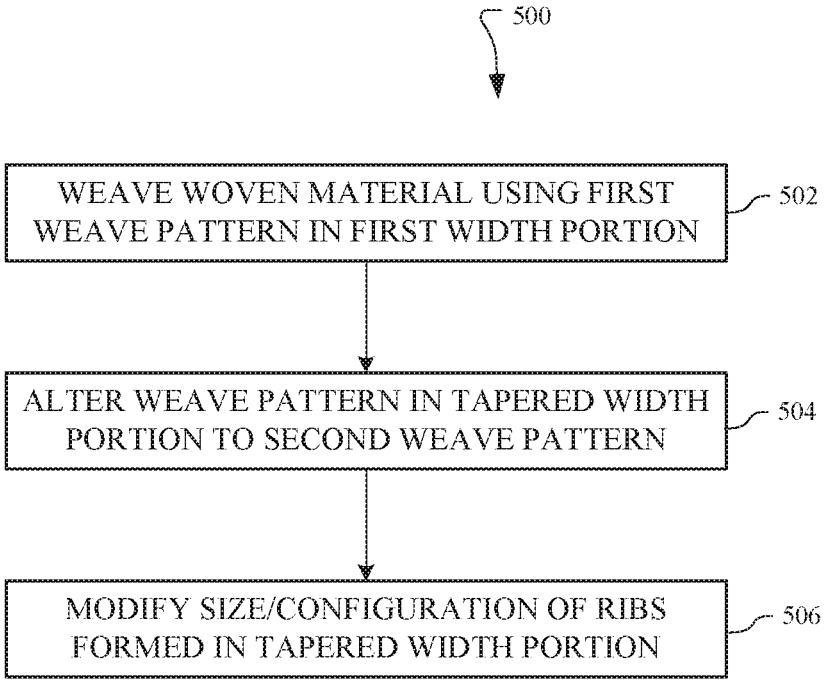
FIG. 20 depicts a flow chart of an example process for forming a woven material having a tapered width portion, according to embodiments.

FIG. 20 depicts an example process for forming a woven material. Specifically, FIG. 20 is a flowchart depicting one example process 500 for forming a woven material that may be utilized in forming a wearable band. In some cases, the process may be used to form the wearable band from woven material, as discussed above with respect to FIGS. 1-19.

In operation 502, a woven material may be woven using a first weave pattern in a first width portion. The woven material may include a plurality (e.g., four) of distinct layers of a plurality of warp threads, where at least a portion of at least one distinct layer of warp threads may be formed from elastic fibers. The woven material also includes at least one weft thread that may be coupled to, woven or interlaced between the plurality of warp threads in each of the four distinct layers. The woven material may also include a plurality of ribs formed on each edge and/or surface of the woven material. The woven material may further include inner columns of warp threads for each of the plurality of layers of warp threads, and two distinct groups of outer columns of warp threads for each of the plurality of layers of warp threads. The two distinct groups of outer columns of warp threads may be positioned on opposite sides of the inner columns of warp threads. In a non-limiting example, the first weave pattern may include each of the plurality of warp threads alternating between being positioned above and below the weft thread, where at least one of the plurality of warp threads is positioned on an opposite side of the weft thread than a distinct and/or adjacent warp thread.

In operation 504, the weave pattern of the woven material may be altered to a second weave pattern in a tapered width portion. The tapered width portion may be formed directly adjacent the first width portion. The second weave pattern may be distinct from the first weave pattern for the woven material. The altering of the weave pattern of the woven material to the second weave pattern may include altering the weave pattern to the second weave pattern in at least a portion of at least two layers of the plurality of layers of warp threads forming the woven material. In a non-limiting example, the altering of the weave pattern of the woven material to the second weave pattern may further include weaving the two distinct groups of outer columns of warp threads using the second weave pattern in the tapered width portion, and weaving the inner columns of warp threads using the first weave pattern in the tapered width portion. In another non-limiting example, the altering of the weave pattern of the woven material to the second weave pattern in tapered width portion may further include increasing the tension of the elastic fibers forming at least a portion of the warp threads in at least one layer of the plurality of distinct layers of warp threads. The increased tension on the plurality of elastic fibers in the tapered width portion may be greater than the tension of the plurality of elastic fibers positioned in the first width portion.

In operation 506, a size and/or a configuration of the plurality of ribs formed in the tapered width portion of the woven material may be modified. The modification of the size and/or configuration of the ribs of the woven material may be a result of the altering of the weave pattern of the woven material to the second weave pattern in the tapered width portion in operation 504. The modifying of the size and/or configuration of the plurality of ribs may further include smoothing, flattening and/or elongating the ribs of the woven material in the tapered width portion of the woven material. Additionally, modifying the size and/or configuration of the plurality of ribs may also include reducing the thickness of the tapered width portion of the woven material forming a substantially even or uniform thickness, appearance, and/or tactile feature throughout (e.g., first width portion, tapered width portion) the woven material.

The weave pattern of a woven material may be altered to modify the size and/or configuration of ribs formed on an edge and/or in a tapered portion of the woven material. Specifically, the woven material may include an altered weave pattern in its tapered width portion to reduce the size and/or flatten the ribs formed in the edge of the woven material. This may ultimately make the thickness and/or side profile of the tapered portion uniform with the remaining portion of the woven material. The altering of the weave pattern may be achieved by altering the weave pattern in a portion or all of the layers of the multi-layer woven material. Furthermore, the altering of the weave pattern may only take place in portions of the tapered portion positioned adjacent the edge of the woven material. Additionally, the altering of the weave pattern may be achieved by altering a tension placed on elastic fibers forming a portion or all of the weft threads in at least some of the layers of the multi-layer woven material. The tension on the elastic fibers in the tapered width portion may be greater than the tension on the elastic fibers in the remaining portions of the woven material.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

We claim:

1. A woven watch band comprising:

outer columns of warp threads;

inner columns of warp threads positioned between the outer columns of warp threads;

a uniform width portion, in which a first weave pattern is formed in a plurality of layers of warp threads of the outer columns and of the inner columns; and a tapered width portion formed adjacent the uniform width portion, in which the first weave pattern is formed in the plurality of layers of warp threads of the inner columns and a second weave pattern is formed in at least a portion of the plurality of layers of warp threads of the outer columns, wherein the second weave pattern is distinct from the first weave pattern.

2. The woven watch band of claim 1, wherein the plurality of layers of warp threads of the outer columns and of the inner columns comprises:

a first layer of warp threads forming a top surface;

a second layer of warp threads positioned adjacent the first layer;

a third layer of warp threads positioned adjacent the second layer; and a fourth layer of warp threads positioned adjacent the third layer, the fourth layer forming a bottom surface;

wherein at least one weft thread is positioned between the warp threads over a length of each of the four layers of warp threads.

3. The woven watch band of claim 2, wherein the first weave pattern further comprises:

the warp thread alternating between being positioned above and below the at least one weft thread.

4. The woven watch band of claim 2, wherein the second weave pattern is formed in the four layers of warp threads in each of the outer columns of warp threads.

5. The woven watch band of claim 2, wherein the second weave pattern is formed in at least two layers of the four layers of warp threads in each of the outer columns of warp threads.

6. The woven watch band of claim 5, wherein the second weave pattern is formed in:

the second layer of warp threads in each of the outer columns of warp threads; and the third layer of warp threads in each of the outer columns of warp threads.

7. The woven watch band of claim 6, wherein the first weave pattern is formed in:

the first layer of warp threads in each of the outer columns of warp threads; and the fourth layer of warp threads in each of the outer columns of warp threads.

8. The woven watch band of claim 5, wherein the second weave pattern is formed in:

the first layer of warp threads in each of the outer columns of warp threads; and the fourth layer of warp threads in each of the outer columns of warp threads.

9. The woven watch band of claim 8, wherein the first weave pattern is formed in:

the second layer of warp threads in each of the outer columns of warp threads; and the third layer of warp threads in each of the outer columns of warp threads.

10. The woven watch band of claim 2, wherein the second weave pattern further comprises the warp threads of the outer columns alternating between being positioned:

in a first position with respect to the at least one weft thread for a first predetermined length; and in a second position with respect to the at least one weft thread for a second predetermined length; the second position distinct from the first position.

11. The woven watch band of claim 10, wherein the first position with respect to the at least one weft thread comprises one of:

positioned above the at least one weft thread, or positioned below the at least one weft thread.

12. The woven watch band of claim 10, wherein the first predetermined length further comprises:

two distinct passes of the at least one weft thread positioned between the four layers of warp threads.

13. The woven watch band of claim 12, wherein the second predetermined length further comprises one of:

a single pass of the at least one weft thread positioned between the four layers of warp threads, or two passes of the at least one weft thread positioned between the four layers of warp threads.

* * * * *